United States Patent [19]

Sponseller et al.

[11] 4,453,986

[45] Jun. 12, 1984

[54] TUBULAR HIGH STRENGTH LOW ALLOY STEEL FOR OIL AND GAS WELLS

[75] Inventors: David L. Sponseller, Ann Arbor, Mich.; John A. Straatman, Poland, Ohio

[73] Assignee: Amax Inc., Greenwich, Conn.

[21] Appl. No.: 433,326

[22] Filed: Oct. 7, 1982

[51] Int. Cl.[3] ..... C21D 8/10

[52] U.S. Cl. ..... 148/12 F; 148/36

[58] Field of Search ..... 148/36, 12 F, 12.4, 148/144, 143, 12 R; 75/123 J, 126 C

[56] References Cited

U.S. PATENT DOCUMENTS

| | | | |
|---|---|---|---|
| 3,539,404 | 11/1970 | DeRetana | 148/12.4 |
| 3,915,697 | 10/1975 | Gioliani et al. | 148/36 |
| 3,976,514 | 8/1976 | Matsukura et al. | 148/12 F |
| 4,008,103 | 2/1977 | Miyoshi et al. | 148/12 F |
| 4,204,892 | 5/1980 | Economopolous | 148/12.4 |
| 4,300,598 | 11/1981 | Royer et al. | 148/36 |
| 4,388,123 | 6/1983 | Murayama | 148/36 |

FOREIGN PATENT DOCUMENTS

| | | | |
|---|---|---|---|
| 66818 | 6/1978 | Japan | 148/36 |
| 58615 | 5/1979 | Japan | 75/123 J |
| 118327 | 9/1979 | Japan | 148/143 |
| 97423 | 7/1980 | Japan | 148/36 |
| 166324 | 12/1981 | Japan | 148/12 R |

OTHER PUBLICATIONS

Iron Age, Nov. 12, 1980, "Materials Come First in Sour Gas Drilling", pp. 1–6.

*Primary Examiner*—Peter K. Skiff

*Attorney, Agent, or Firm*—Michael A. Ciomek; Eugene J. Kalil

[57] ABSTRACT

An article of manufacture is provided comprising a heat treated high strength low-alloy steel tubular product of the L-80 and N-80 type suitable for use as an oil well tubular member. The composition consists essentially of about 0.1 to 0.4% C, about 0.075 to 0.4% Mo, about 0.002 to 0.03% N, about 0.75 to 1.5% Mn, about 0.1 to 0.4% Si, and the balance essentially iron, the carbon and molybdenum contents being controlled and correlated such that for a carbon content ranging from about 0.1 to 0.25%, the molybdenum content ranges from about 0.075 to 0.25%; and for a carbon content ranging from about 0.25 to 0.4%, the molybdenum content ranges from about 0.2 to 0.4%.

3 Claims, 26 Drawing Figures

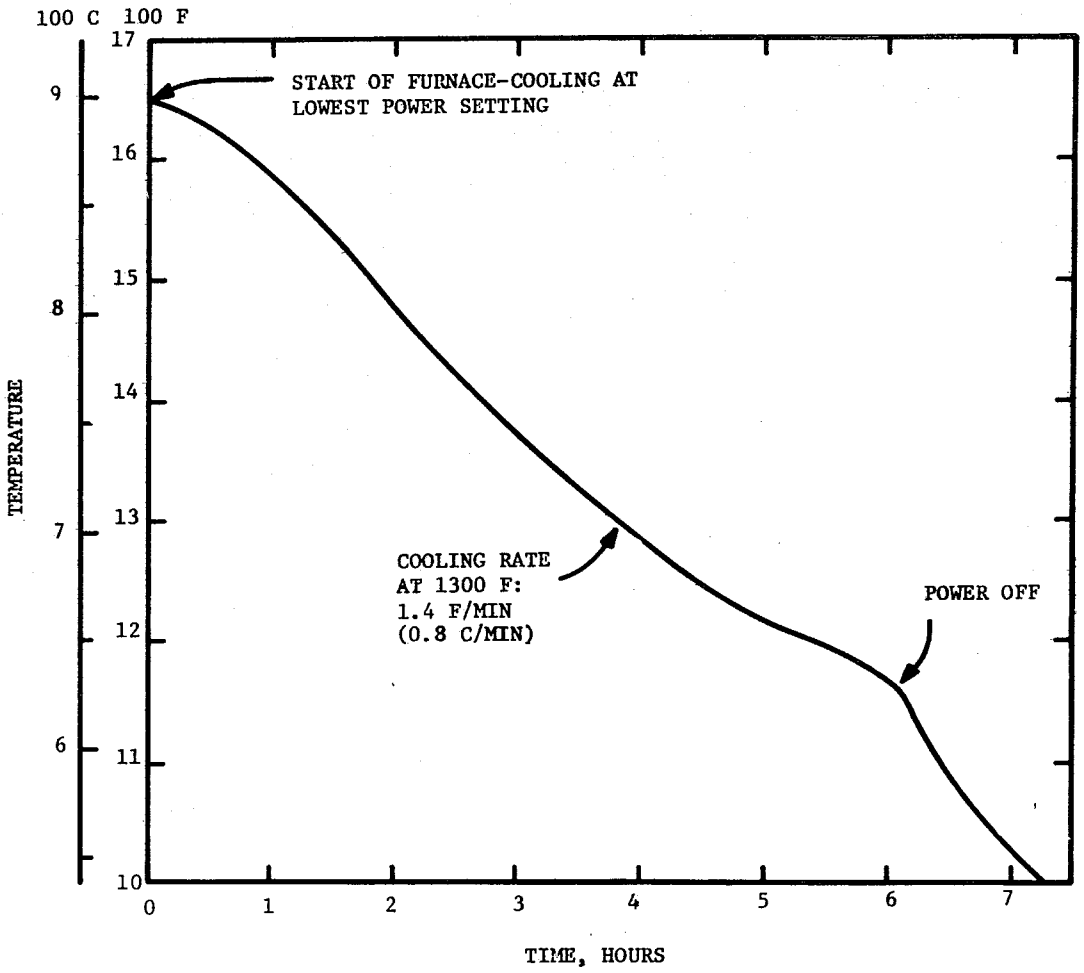
FIG. 1 - Cooling Curve for the Plates of All Steels, Annealed for One Hour at 900 C (1650 F). The plates were furnace-cooled through the transformation range to simulate the cooling of hot-coiled ERW steel.

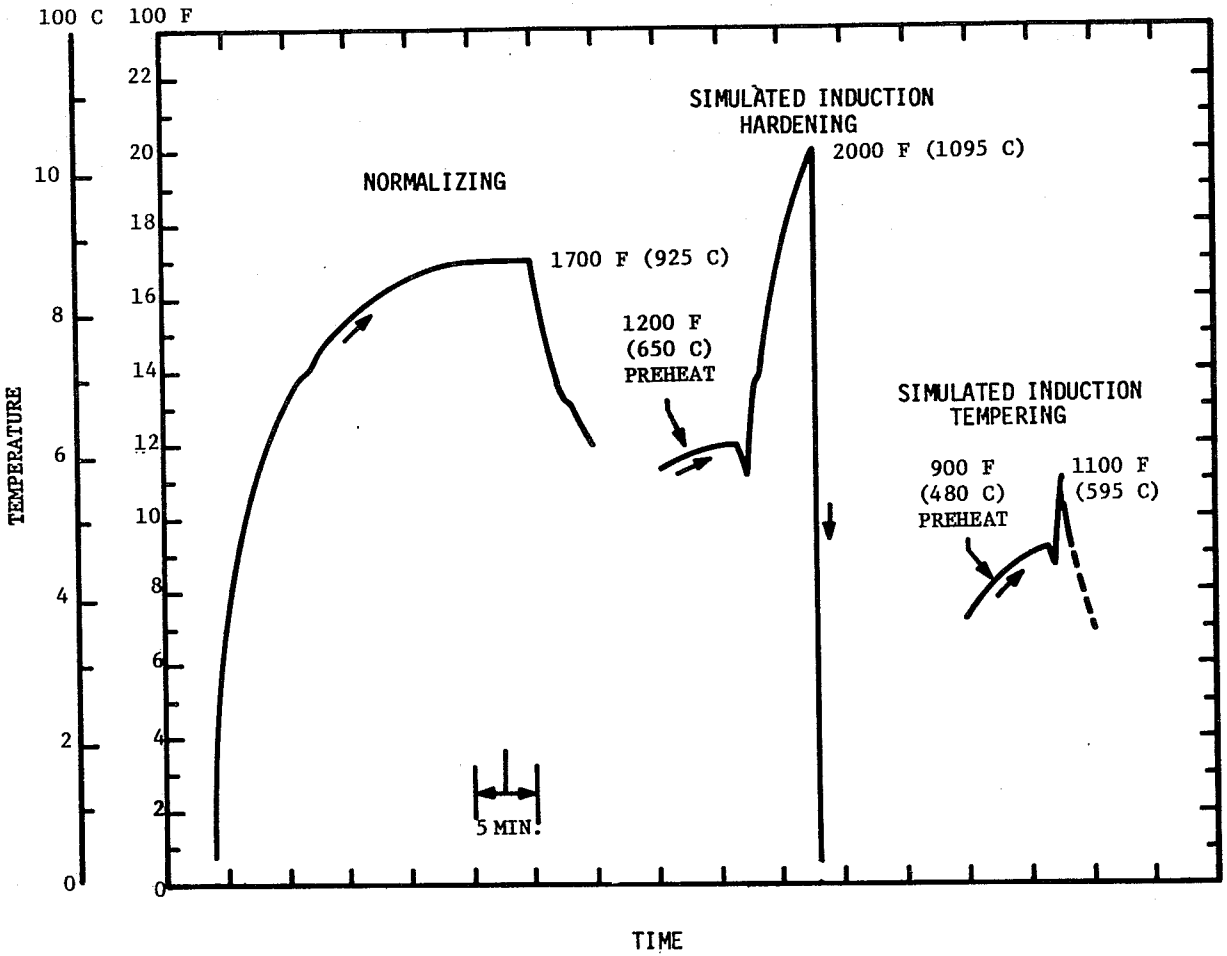
FIG. 2- Actual Heating and Cooling Curves Obtained during Heat-Treating of Experimental Steels. These treatments were intended to simulate mill-processing.

2% Nital X100

2% Nital X500

Microstructure of Reference Q&T-Type N-80 Steel Containing 0.25% C and 1.25% Mn in the Simulated Hot Band Condition.

2% Nital X100

2% Nital X500

Microstructure of Steel A Containing 0.20% C and 0.10% Mo in the Simulated Hot Band Condition.

2% Nital X100

2% Nital X500

Microstructure of Steel C Containing 0.15% C and 0.10% Mo in the Simulated Hot Band Condition.

2% Nital X100

2% Nital X500

Microstructure of Steel D1 Containing 0.10% C, 0.10% Mo, and 0.05% Nb in the Simulated Hot Band Condition.

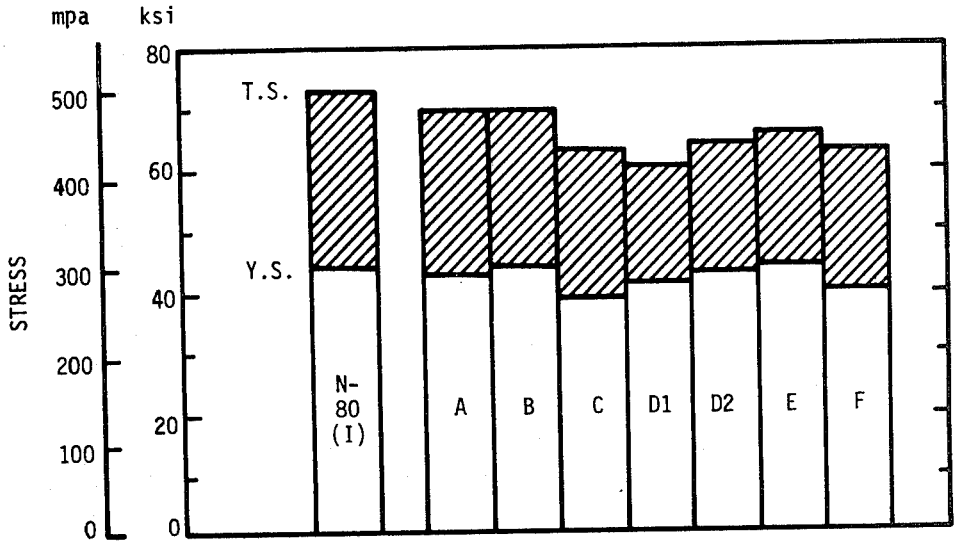
FIG. 7 Yield and Tensile Strengths of Plates of Q and T-Type Steels, Annealed for One Hour at 1650 F (900 C). The plates were furnace-cooled through the transformation range to simulate the cooling of hot-coiled ERW steel.

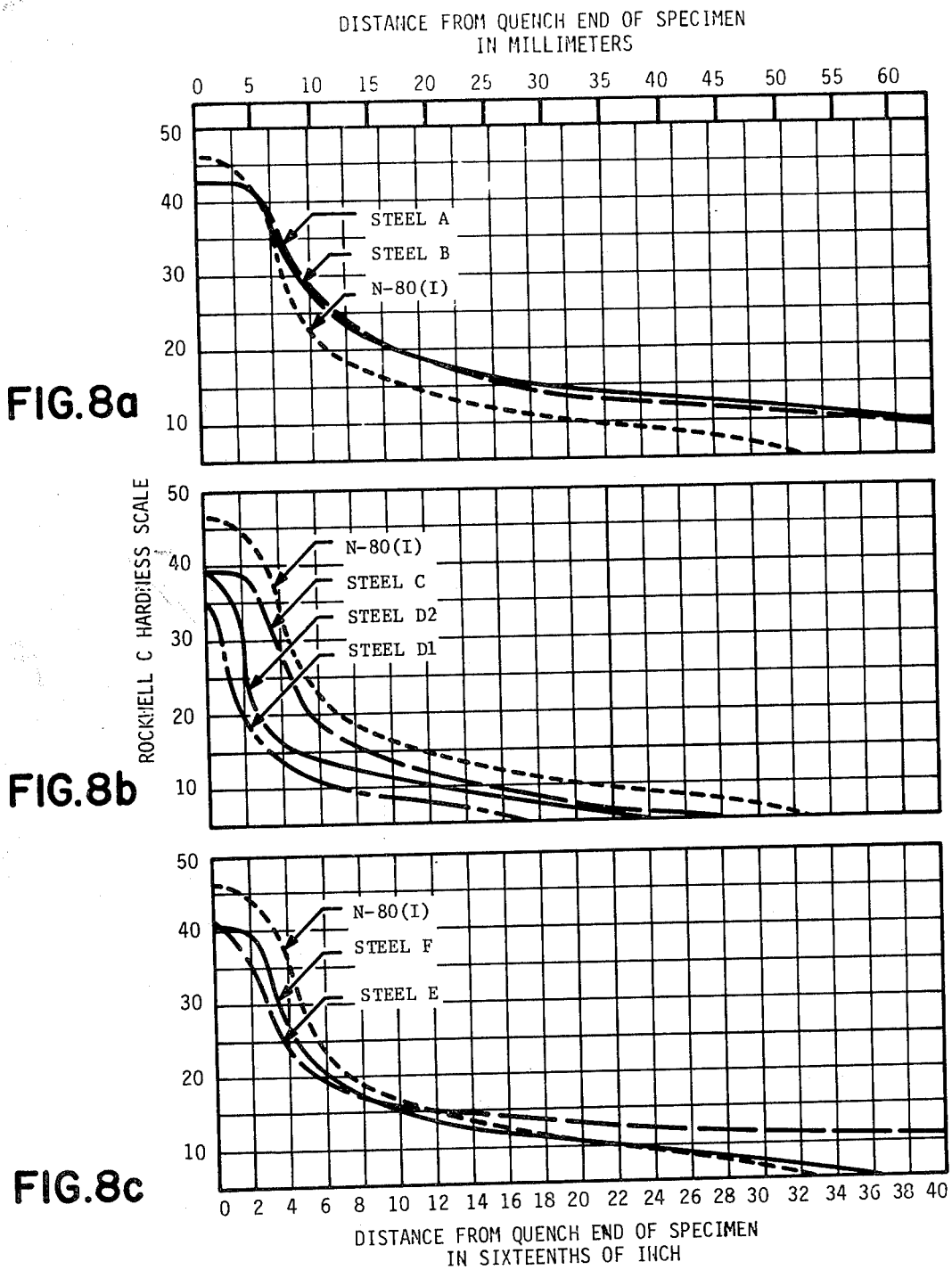
Jominy End-Quench Hardenability Curves for Q and T-Type Steels. Specimens were heated rapidly to 1095 C (2000 F) and then end-quenched to simulate the induction hardening of the inner surface of 0.4 in. (10 mm) wall casing.

X500

X5000

Microstructure of Q&T Reference Steel N-80(I). Peak tempering temperature: 1300 F (705 C). Etchant: 4% picric acid and 1% nitric acid in ethanol. a) Optical micrograph, b) Scanning electron micrograph.

X500

X5000

Microstructure of Q&T Steel B Containing 0.20% C and 0.15% Mo. Peak tempering temperature: 1300 F (705 C). Etchant: 4% picric acid and 1% nitric acid in ethanol. a) Optical micrograph, b) Scanning electron micrograph.

X500

X5000

Microstructure of Q&T Steel C Containing 0.15% C and 0.10% Mo. Peak tempering temperature: 1300 F (705 C). Etchant: 4% picric acid and 1% nitric acid in ethanol. a) Optical micrograph, b) Scanning electron micrograph.

X500

X5000

Microstructure of Q&T Steel D1 Containing 0.10% C, 0.10% Mo and 0.05% Nb. Peak tempering temperature: 1300 F (705 C). Etchant: 4% picric acid and 1% nitric acid in ethanol. a) Optical micrograph, b) Scanning electron micrograph.

X500

X5000

Microstructure of Q&T Steel F Containing 0.15% C and 0.20% Mo. Peak tempering temperature: 1300 F (705 C). Etchant: 4% picric acid and 1% nitric acid in ethanol. a) Optical micrograph, b) Scanning electron micrograph.

Effect of Peak Tempering Temperature on the Hardness and Tensile Properties of N-80 (I) and Steels A, B, and C in the Simulated Induction-Hardened-and-Tempered Condition.

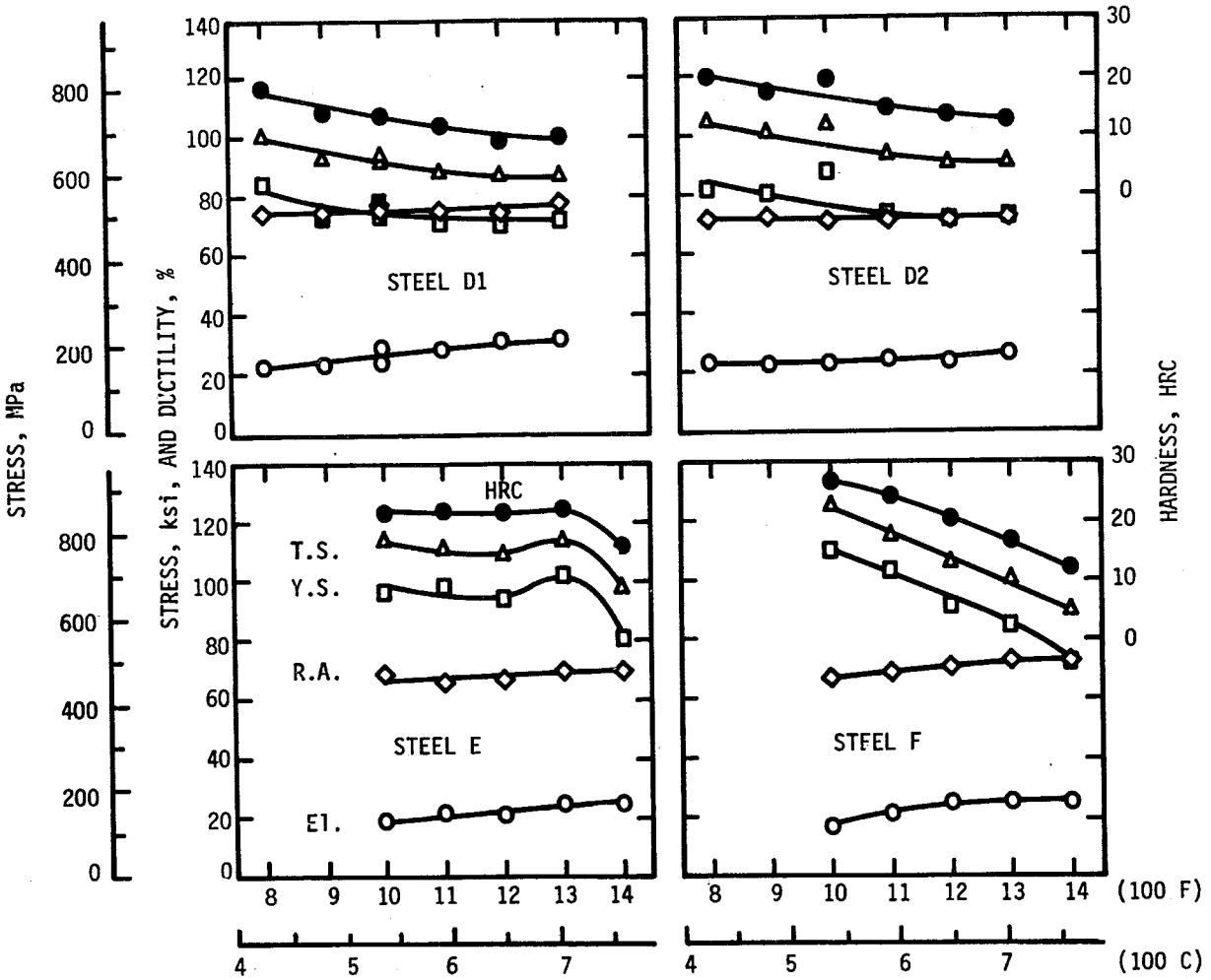
FIG. 15 Effect of Peak Tempering Temperature on the Hardness and Tensile Properties of Steels D1, D2, E, and F in the Simulated Induction-Hardened-and-Tempered Condition.

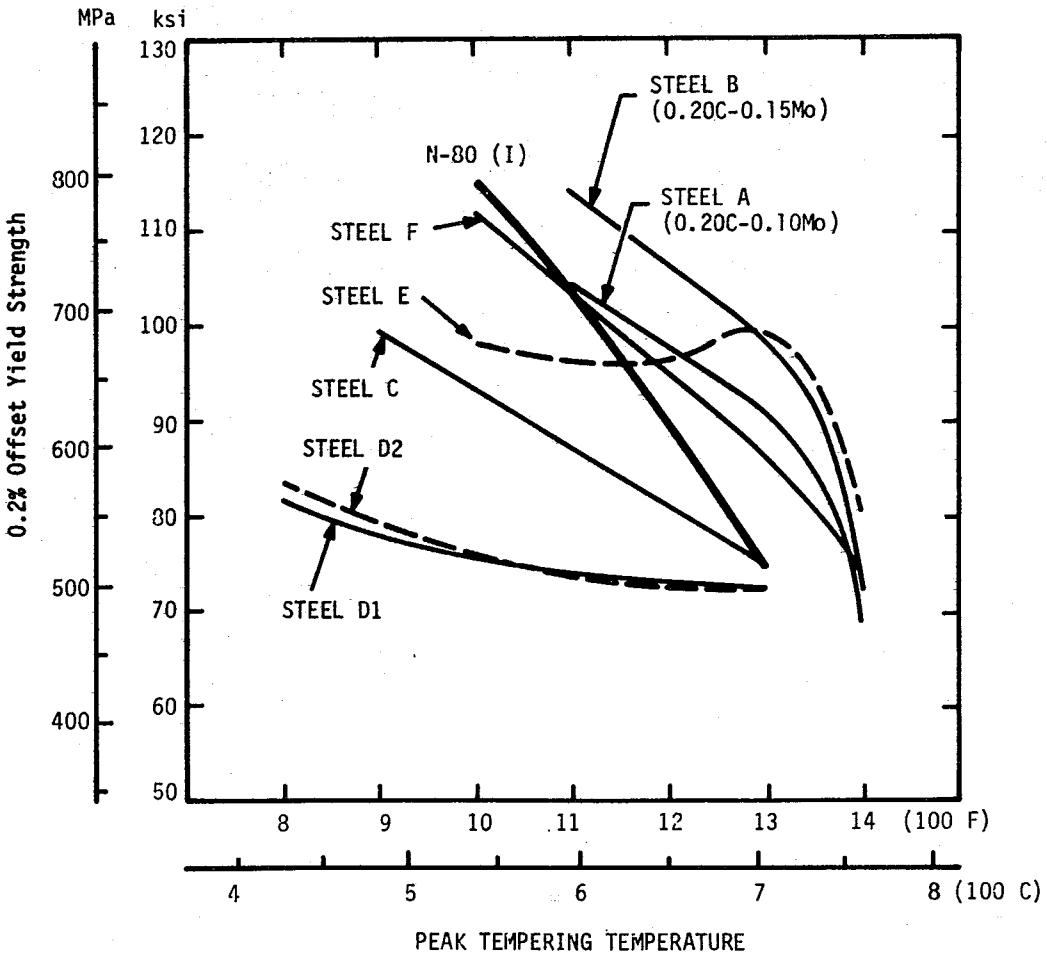
FIG. 16 Effect of Peak Tempering Temperature on the Yield Strength of Conventional and Experimental ERW Steels in the Simulated Induction-Hardened-and-Tempered Condition.

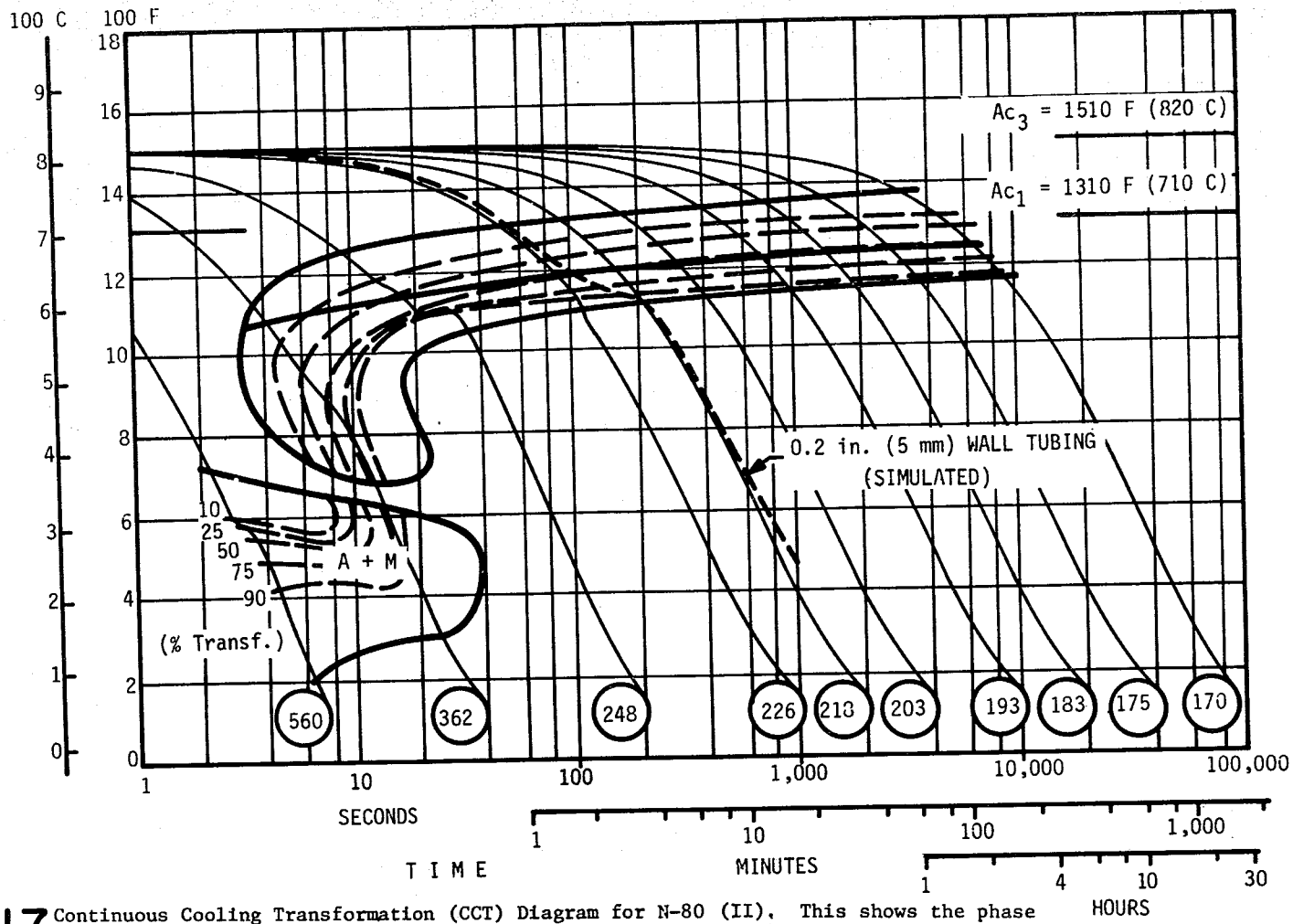
FIG. 17 Continuous Cooling Transformation (CCT) Diagram for N-80 (II). This shows the phase transformation during cooling at various rates, following austenitization at 1700 F (925 C) for 5 minutes. The cooling curve for 0.2 in. (5 mm) wall tubing is superimposed.

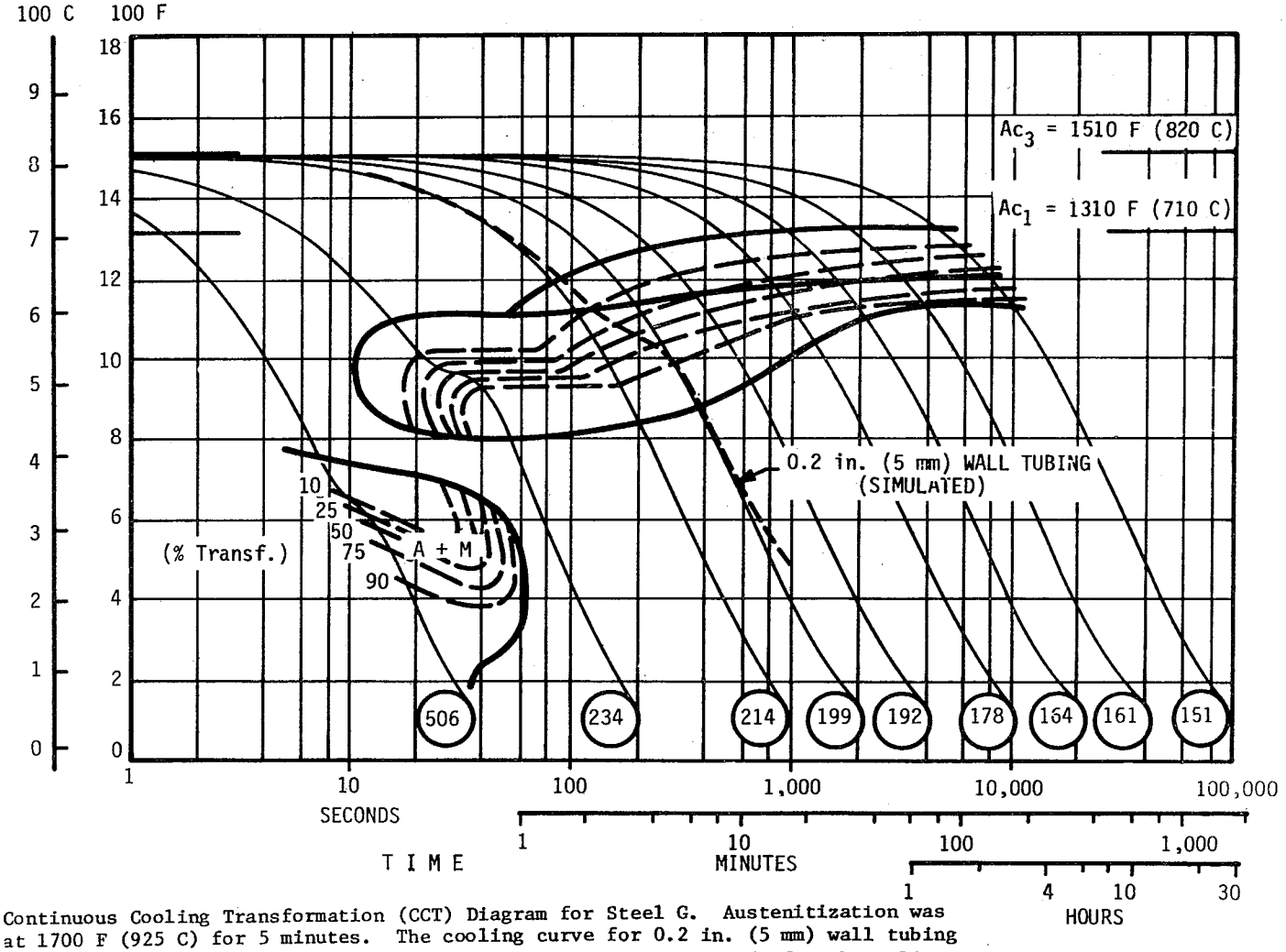
FIG. 18 Continuous Cooling Transformation (CCT) Diagram for Steel G. Austenitization was at 1700 F (925 C) for 5 minutes. The cooling curve for 0.2 in. (5 mm) wall tubing is superimposed. HVL hardness is shown in the circles at the end of each cooling curve.

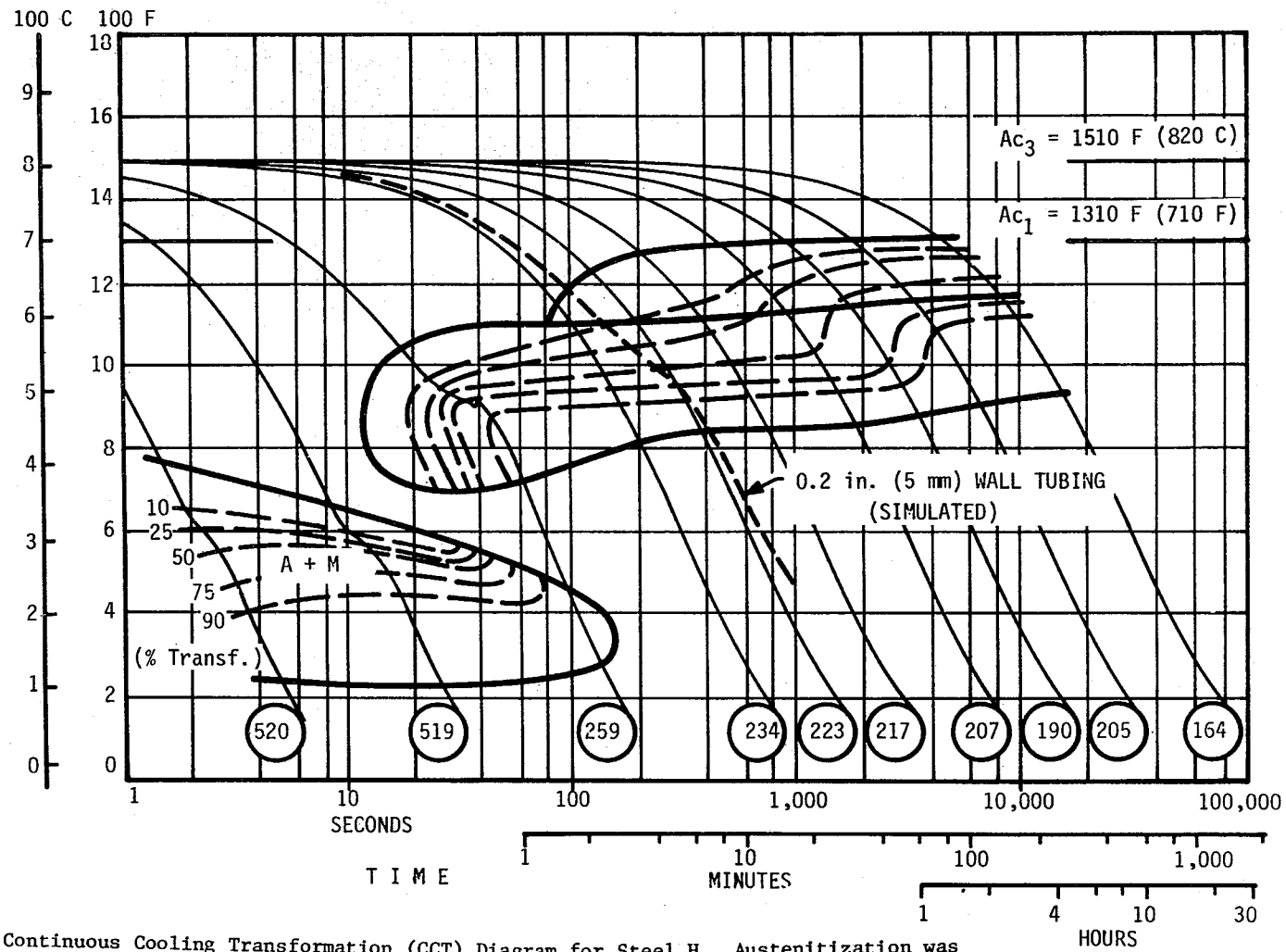
FIG. 19 Continuous Cooling Transformation (CCT) Diagram for Steel H. Austenitization was at 1700 F (925 C) for 5 minutes. The cooling curve for 0.2 in. (5 mm) was tubing is superimposed. HV1 hardness is shown in the circles at the end of each cooling curve.

Steel
N-80 (II)

X1000

Steel G

X1000

Steel H

X1000

Microstructures of Normalized Steels N-80 (II), G and H. Specimens were taken from simulated 0.3 in. (8 mm)-wall tube upset that had been held at 1700 F (925 C) for 5 minutes and air-cooled.

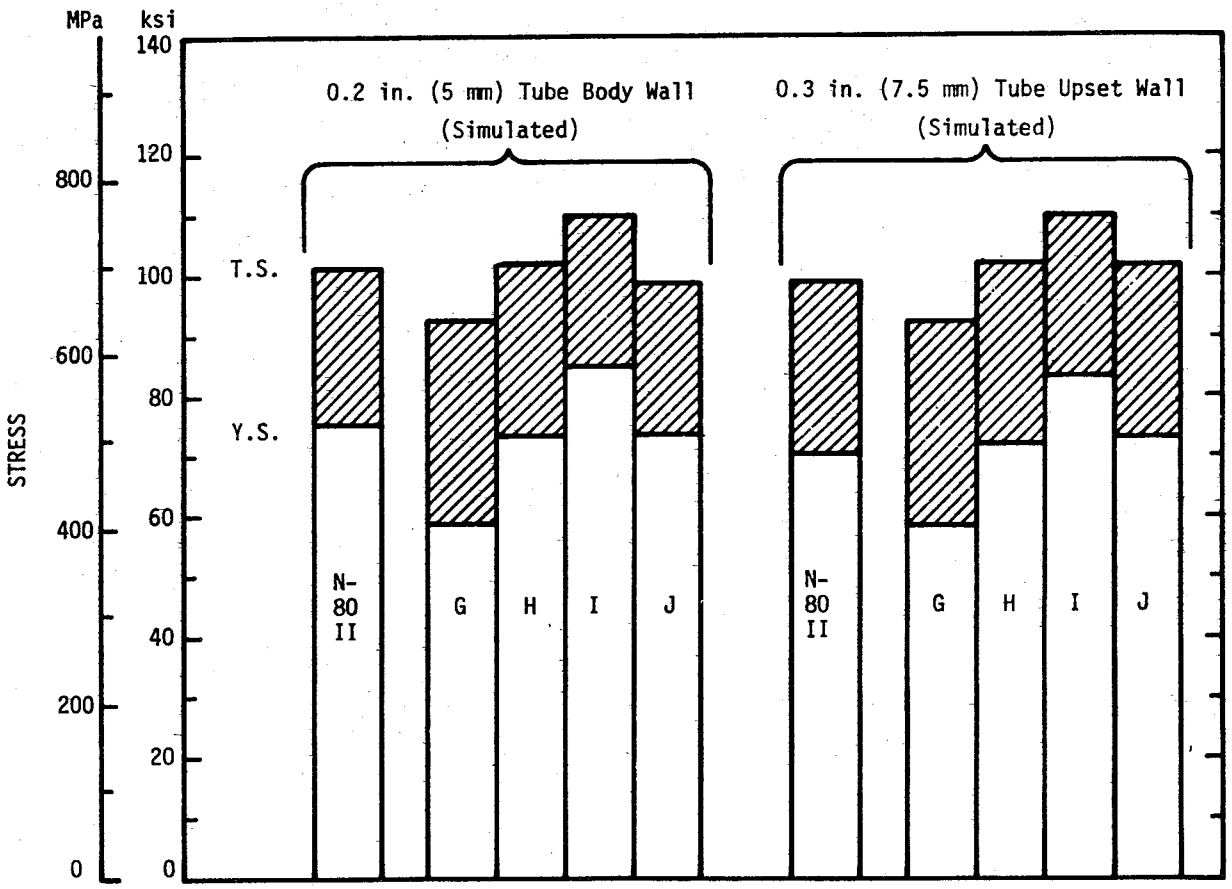
FIG. 21 Yield and Tensile Strengths of Plates of Normalized-Type Steels Representing the Body and Upset Ends of Rapidly Normalized Tubing

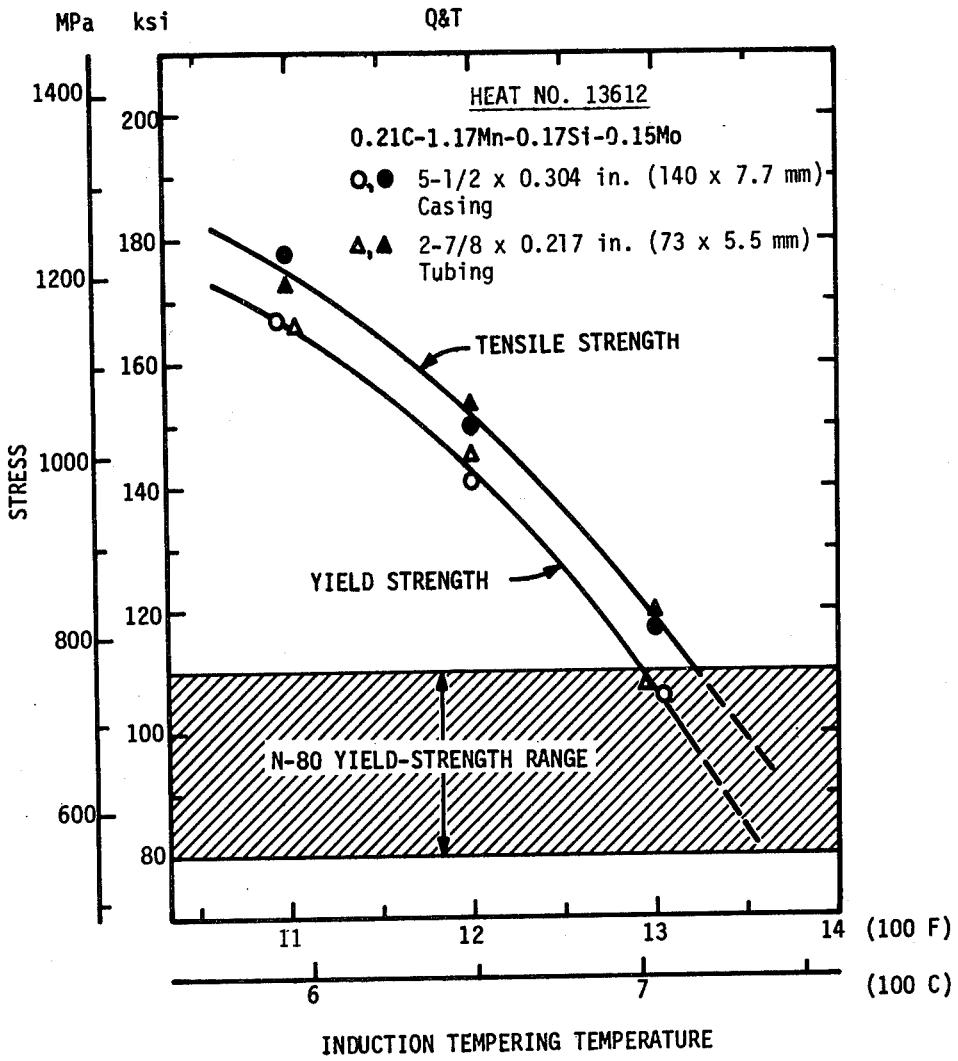
FIG. 22 Effect of Induction-Tempering Temperature on Yield and Tensile Strengths of Q & T Commercially Produced Mn-Mo ERW Casing and Tubing.

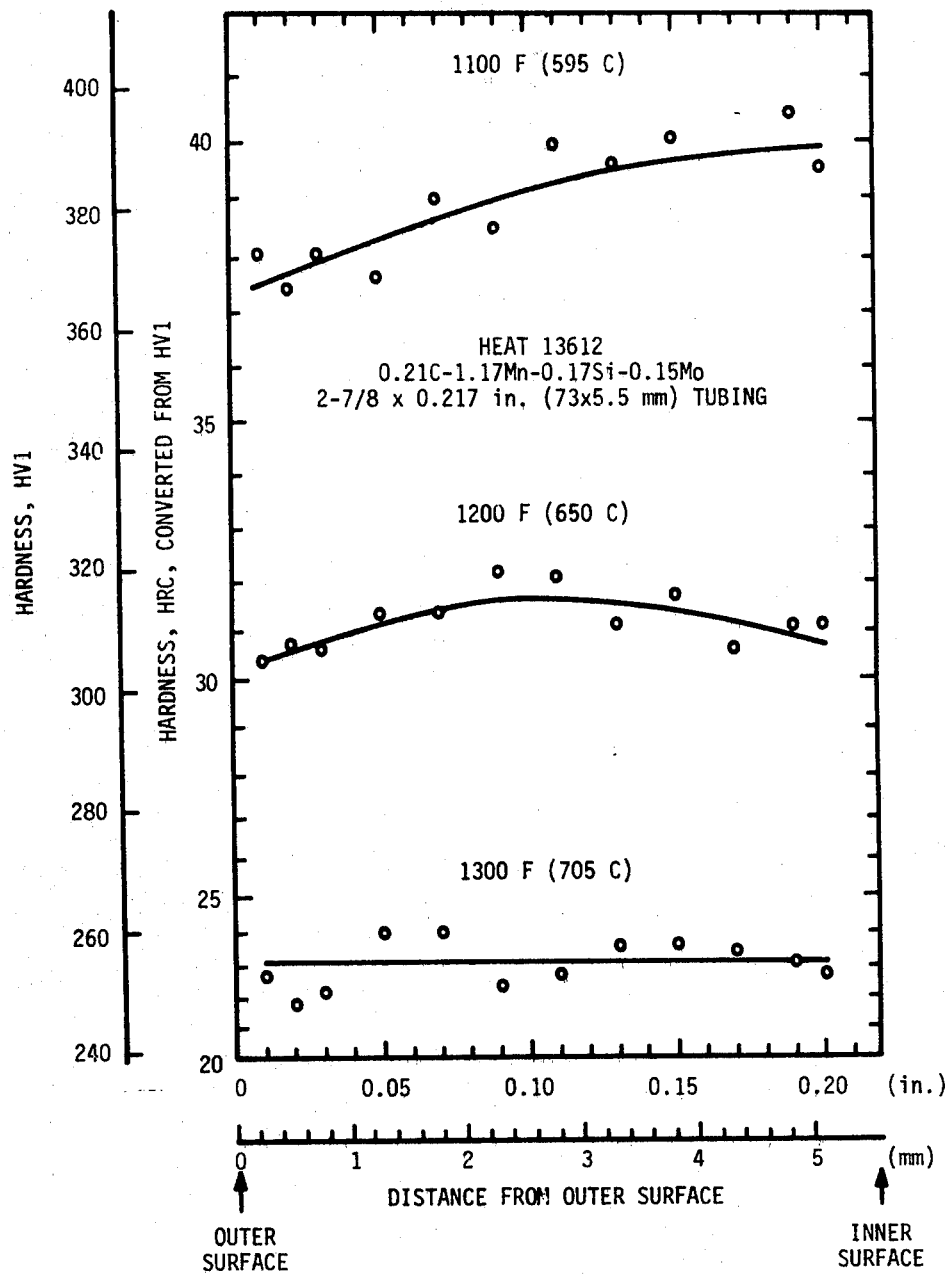
FIG. 23 Results of Microhardness traverses Through the Wall of Commercially Produced Mn-Mo ERW Tubing that Had Been Induction-Heated to 1800 F (980 C), Water-Quenched, and Induction-Heated to the Three Indicated Tempering Temperatures.

2% Nital X500

2% Nital X5000

Microstructure of Commercially Produced ERW Tubing Containing 0.21C-1.17Mn-0.17Si-0.15Mo. This 2-7/8 x 0.217 in. (73 x 5.5 mm) tubing was induction-heated to 1800 F (890 C), water-quenched, and induction-tempered, with a peak temperature of 1300 F (705 C), and has a yield strength of 107 ksi (740 MPa).

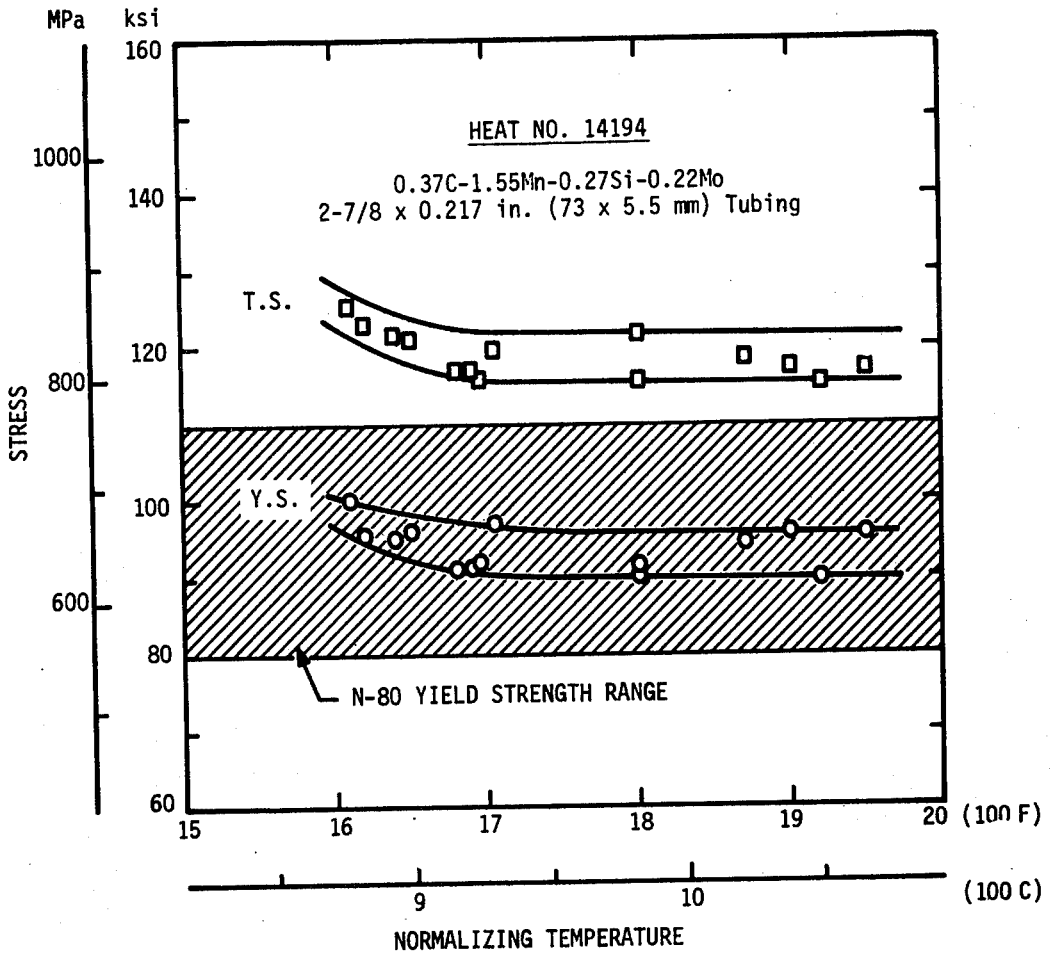
FIG. 25 Effect of Normalizing Temperature on Yield and Tensile Strengths of Commercially Produced Mn-Mo ERW Tubing 2% Nital X500

2% Nital X5000

Microstructure of Commercially Produced ERW Tubing Containing 0.37C-1.55Mn-0.27Si-0.22Mo. This 2-7/8 x 0.217 in. (73 x 5.5 mm) tubing was induction-normalized, with a peak temperature of 1650 F (900 C) and has a yield strength of 96 ksi (660 MPa).

TUBULAR HIGH STRENGTH LOW ALLOY STEEL FOR OIL AND GAS WELLS

This invention relates to high strength low alloy steels suitable for use in the production of L-80 and N-80 type oil well tubular products and, in particular, to (1) quenched and tempered and (2) normalized high strength low alloy steel tubular products and a method therefor.

State of the Art

It is known to use carbon or low alloy steels for the production of pipe, specialty tubing and oil country tubular products. According to the Ninth Edition of the ASM Metals Handbook (Vol. I, 1978, pages 315 to 326), the two simplest and broadest commercial classifications of steel tubular products are tube and pipe which are subdivided into several groups. For instance, the term "tube" generally covers pressure tubes, structural tubing and mechanical tubing, while the term "pipe" is understood to cover standard pipe, line pipe, oil country tubular goods, water well pipe, pressure pipe and the like. Oil country tubular goods generally include drill pipe, casing and tubing.

The unprecedented demand for oil country tubular goods has opened new opportunities for expanded use of electric resistance welded pipe, also referred to as ERW pipe or tubular products. ERW tubulars are produced from hot band material which is uncoiled, slit to make skelp and seam welded. The weld region in lower strength ERW grades such as J-55 may simply be locally normalized. However, in the case of higher strength grades such as L-80 and N-80, the entire welded pipe is either normalized or quenched and tempered. Steels for high strength ERW tubulars should exhibit sufficient hardenability to achieve the required strength, sufficient weldability to provide trouble-free seam welding, and sufficient formability such that the thick-walled tubulars typical of L-80 and N-80 may be slit, formed, and welded on existing ERW lines.

A conventional steel (A) for producing the foregoing grades contains 0.25% C, 1.25% Mn, 0.17% Si and, as a residual, 0.01% P and 0.02% S. This steel is hot rolled to strip which is then hot coiled, cooled, slit to skelp width, formed into a circular cross section, welded, normalized (optional), austenitized, quenched and tempered. Sometimes the pipe or tubular product is stretch reduced prior to heat treatment.

Another conventional steel (B) also employed for producing the aforementioned grades contains 0.33% C, 1.35% Mn, 0.25% Si, 0.10% V, 0.015% N, 0.01% P and 0.02% S. This steel like steel (A) is hot rolled to strip following which it is hot coiled, cooled, slit to skelp width, formed into a circular cross section, welded, optionally stretch reduced, and normalized.

Steel (A) is quite adequate in hot band gauges (i.e., tubular wall thicknesses of up to about 0.36 inch (about 9 mm); however, thicker hot band is usually difficult to form into pipe. Electric resistant welding employs a series of operations wherein flat rolled steel is first cold shaped into tubular form and the welding effected by the application of pressure and heat generated by induction or by an electric current through the seam. Electric resistance welded tubular products have longitudinal seams and are made in various diametrical sizes.

The thin walls and small diameters typical of oil country tubing and some casing permit the use of low-alloy electric resistance welded pipe in the as-normalized condition. Steel (B) is typical of such a steel. However, this vanadium-strengthened steel is highly variable in its processing behavior and presents many problems as does steel (A).

For example, there are three main problems with the processing of steel (A).

(1) The problem of coping with heavier gauges of hot band in the uncoiling-slitting-coiling-uncoiling-forming sequence, due to the difficulty of achieving a low yield strength in a 0.25% C steel.

(2) The problem of achieving a uniform martensitic structure throughout the wall thickness.

(3) The problem of yield strength within the API limits, especially of the L-80 grade.

With respect to the processing of steel (B), the problems include:

(a) Cracking of slabs during early stages of rolling.

(b) Splitting of the hot band and shattering of edges during slitting to skelp widths.

(c) Cracking of the skelp during its formation into a circular cross section.

(d) Cracking along the length of the seam weld initiated during the cutting of the pipe to length.

To overcome the behavior variability of vanadium-strengthened steel, it is common to anneal the steel. However, annealing adds to the cost of the steel and, moreover, annealing requires a costly pickling operation.

It would be desirable to provide high strength low-alloy steel which substantially eliminates the variability characteristic of such conventional steels and avoid the cost-intensive annealing and pickling operation generally required when working with the aforementioned steels.

We have now discovered a low-alloy steel composition containing molybdenum which overcomes the problems inherent in the conventional steels discussed hereinabove. While molybdenum-containing low-alloy steels are known, we have found that by controlling and correlating the carbon, the molybdenum, and the manganese contents, two types of high strength low-alloy steels can be provided in the form of tubular products: (1) one in which the desired properties are achieved in the quenched and tempered (Q & T) condition and (2) another in which the properties are achievable in the normalized condition. In both cases, the hot band produced can be formed easily into tubular shapes at gauge thicknesses up to about 0.4 inch and higher.

Examples of prior low-alloy molybdenum-containing steels include steel 19 in Table 1 on page 404 of Vol. 1 of the Ninth Edition of the ASM Handbook entitled Properties and Selection: Iron and Steels (0.28% C, 1.5% Mn, 0.025% P, 0.25% Si and 0.15% Mo) and the steel given as grade Tla in Table 10 on page 324 of the same publication (0.15 to 0.25% C, 0.3 to 0.8% Mn, 0.045% P, 0.045% S, 0.1 to 0.5% Si, and 0.44 to 0.65% Mo).

OBJECTS OF THE INVENTION

It is an object of the invention to provide a method for producing high strength low-alloy tubular products in which behavior variability is substantially eliminated.

Another object is to provide as an article of manufacture a heat treated, for example, a quenched and tempered or a normalized, steel tubular product formed of a high strength low-alloy steel composition.

A still further object is to provide a new and improved high strength low-alloy steel of the L-80 and N-80 type suitable for producing oil country tubular products of large cross sectional thicknesses in either the quench and tempered or the normalized conditions.

These and other objects will more clearly appear from the following disclosure, the claims and the accompanying drawings, wherein:

FIG. 1 depicts the cooling curve for the steel plates tested;

FIG. 2 are heating and cooling curves obtained during the heat treatment of the steels tested;

Figure 14:
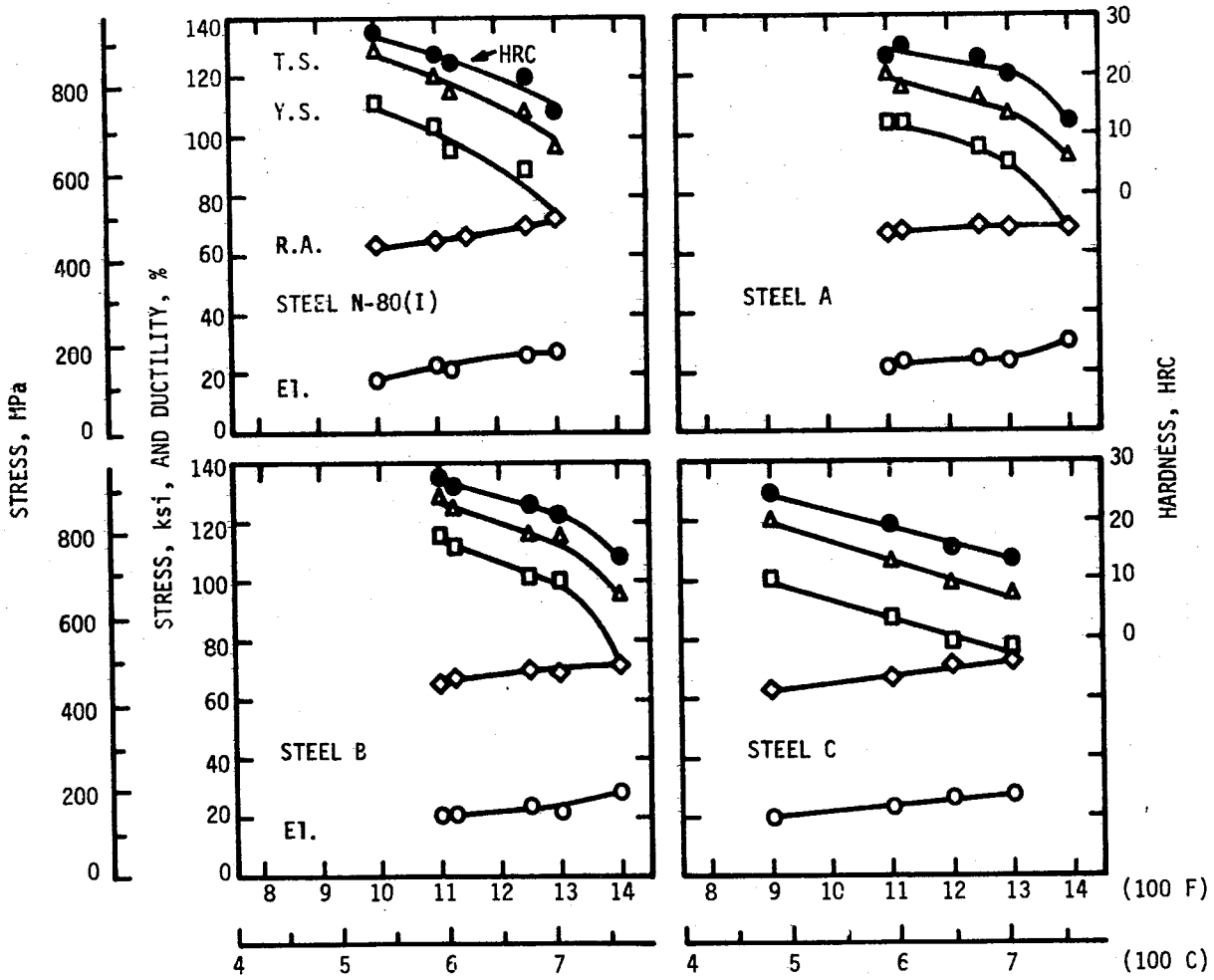
Figure 20A:
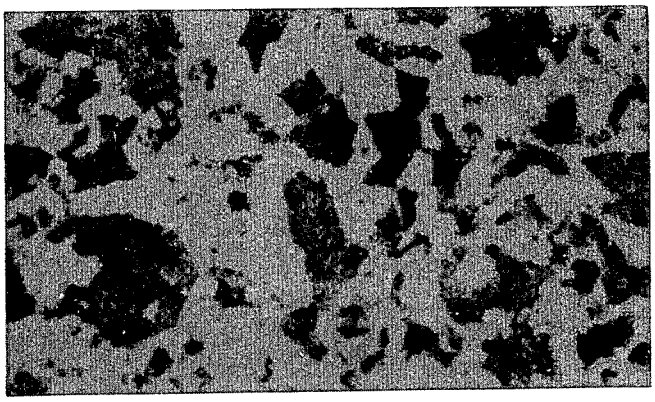
Figure 20B:
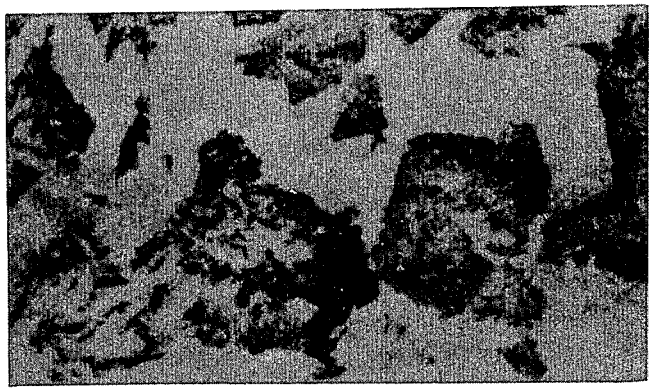
Figure 20C:
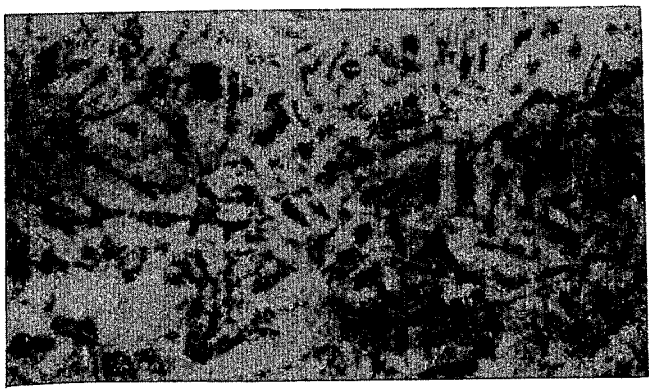
Figure 24A:
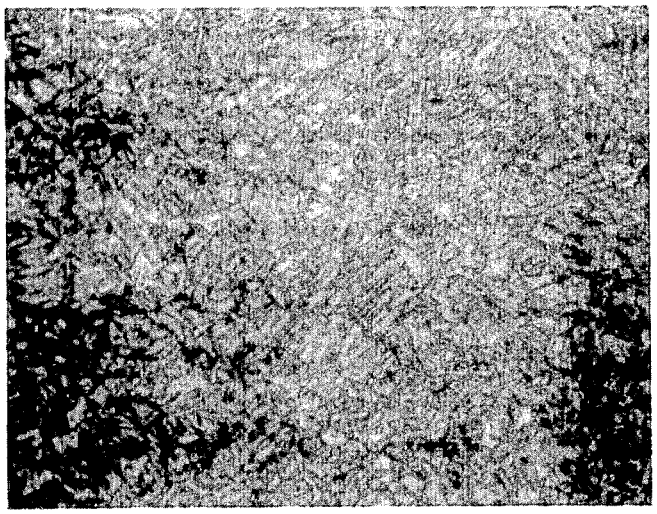
Figure 24B:
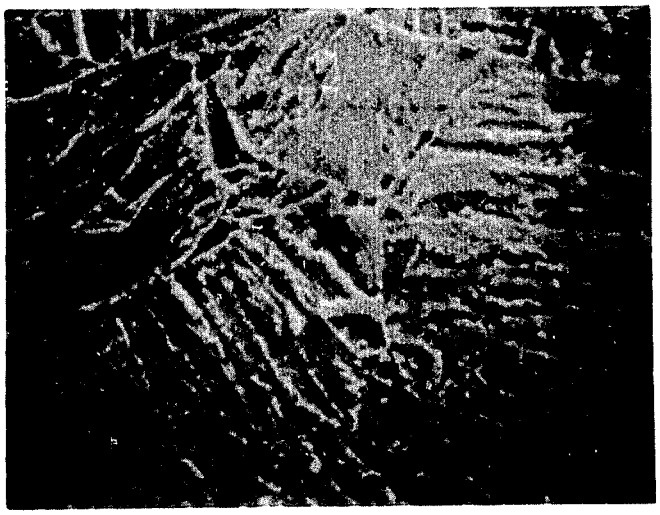
Figure 26A:
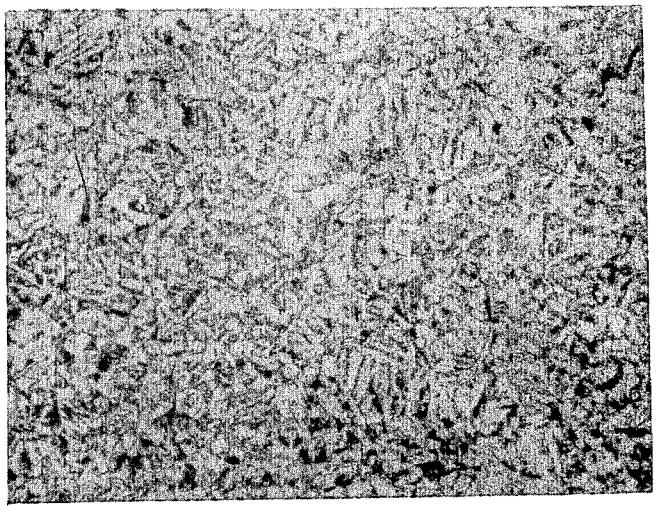
Figure 26B:
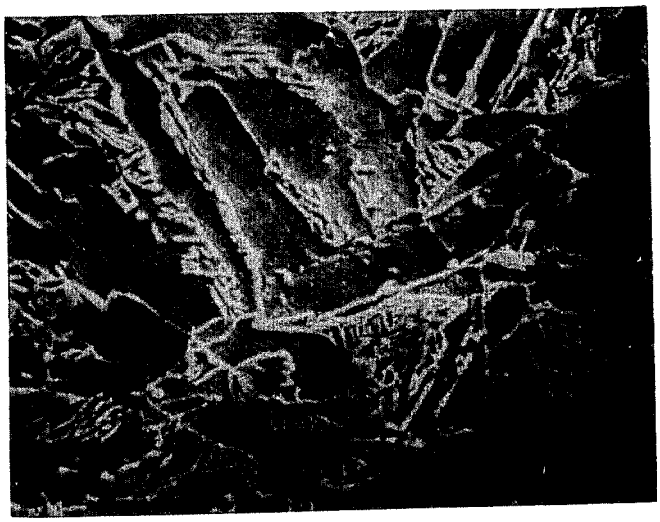

FIGS. 3 to 6 (comprising FIGS. 3*a*, 3*b*, 4*a*, 4*b*, 5*a*, 5*b*, 6*a* and 6*b*) are photomicrographs of certain steels tested taken at 100 and 500 times magnification; respectively;

FIG. 7 is a graphical representation of the yield and tensile strengths of steel plates of the quenched and tempered (Q & T) type steels;

FIG. 8 (comprising FIGS. 8*a*, 8*b* and 8*c*) is illustrative of Jominy end-quench hardenability curves of Q & T type steels end-quenched from 1095° C. (2000° F.);

FIGS. 9 to 13 (comprising FIGS. 9*a*, 9*b*, 10*a*, 10*b*, 11*a*, 11*b*, 12*a*, 12*b*, 13*a* and 13*b*) are photomicrographs of certain Q & T steels taken at 500 and 5000 times magnification;

FIGS. 14 and 15 are curves showing the effect of peak tempering temperature on the hardness and tensile properties of the steels tested;

FIG. 16 depicts a set of curves for certain steel compositions showing the effect of peak tempering temperature on the yield strength of said steels, including a conventional steel;

FIGS. 17 to 19 are continuous cooling transformation (CCT) diagrams for steels N-80 (II), G and H, respectively;

FIG. 20 (comprising FIGS. 20*a*, 20*b* and 20*c*) depicts three photomicrographs of steels N-80(II), G and H at 1000 times magnification showing the microstructure of the steels in the normalized condition;

FIG. 21 is a graphical representation of the yield and tensile strengths of certain of the plates of normalized-type steels representing the body and the upset ends of rapidly normalized tubing;

FIG. 22 shows a set of curves depicting the effect of induction-tempering temperature on the yield and tensile strengths of Q & T produced Mn-Mo casing and tubing;

FIG. 23 shows the results in the form of curves of microhardness reading taken across the wall thickness of Mn-Mo tubing following induction heating to 1800° F. (980° C.) and water quenching and induction heating to the three indicated temperatures;

FIG. 24 (comprising FIGS. 24*a* and 24*b*) depicts two photomicrographs of ERW tubing taken at 500 and 1000 times magnification, respectively, having a composition of 0.21 C, 1.17 Si and 0.15 Mo which has been induction heated to 1800° F. (980° C.), water-quenched and induction tempered at a peak temperature of 1300° F. (705° C.), the steel having a yield strength of about 107 ksi (740 MPa);

FIG. 25 represents curves which show the effect of normalizing temperature on yield and tensile strengths of Mn-Mo ERW tubing resulting from full scale production; and FIG. 26 (comprising FIGS. 26*a* and 26*b*) shows two photomicrographs taken at 500 and 5000 times magnification, respectively, of ERW tubing having a composition containing 0.37 C, 1.55 Mn, 0.27 Si and 0.22 Mo in which the tubing has been induction-normalized at a peak temperature of 1650° F. (900° C.) and has a yield strength of 96 ksi (660 MPa).

STATEMENT OF THE INVENTION

One embodiment of the invention resides in a method for producing a tubular product of a high strength low-carbon steel of the L-80 and N-80 type, the method comprising, establishing a steel bath consisting essentially of about 0.1 to 0.4% C, about 0.075 to 0.3% Mo, about 0.002 to 0.03% N, about 0.75 to 1.5% Mn, and about 0.1 to 0.4% Si, and the balance essentially iron, forming an ingot thereof and converting the ingot into a hot rolled band of predetermined thickness for use in producing a tubular product. The method further includes slitting the band into skelp of a predetermined width for cold forming in a tubular product, cold forming the skelp into a tubular shape with its opposite edges in abutting relationship, subjecting the abutted edges to electric resistance seam welding to produce a seam-welded tubular product of unitary structure, and then heat treating said tubular product to provide properties of the L-80 and N-80 type tubular product.

Another embodiment of the invention resides in an article of manufacture comprising a heat treated high strength low-alloy steel tubular product of the L-80 and N-80 type suitable for use as an oil well tubular member. The product is formed of a composition consisting essentially of about 0.1 to 0.4% C, about 0.075 to 0.3% Mo, about 0.002 to 0.03% N, about 0.75 to 1.5% Mn, about 0.1 to 0.4% Si, and the balance essentially iron; the carbon and molybdenum contents being controlled and correlated such that for a carbon content ranging from about 0.1 to 0.25%, the molybdenum content ranges from about 0.075 to 0.25%; and for a carbon content ranging from about 0.25 to 0.4%, the molybdenum content ranges from about 0.2 to 0.4%. The heat treated tubular product may be a quenched and tempered product or a normalized product so long as the heat treated product is of the L-80 and N-80 type.

DETAILS OF THE INVENTION

As illustrative of the invention, the following example is given:

EXAMPLE

Melting

Small heats of about 50 lbs (23 kg) were produced by induction melting in alumina crucibles. The charge was made up of electrolytic iron, carbon, ferromanganese, ferrosilicon, pure molybdenum pellets, ferroniobium, ferrovanadium, ferrophosphorus, iron sulfide, manganese nitride, and aluminum for deoxidation. All steels but two were made by the split-heat technique, which afforded two different compositions per heat. Low-nitrogen heats were melted in a vacuum furnace back-filled with 0.5 atm. argon. High-nitrogen heats were melted under a slight positive pressure of a gas mixture comprised of 15% nitrogen, balance argon. Two ingots, 3.5 in. (90 mm) in diameter by 7 in. (180 mm) in height were cast from each heat. Chemical analyses were performed on chips and on a spectrographic sample taken from each ingot. Compositions of the two N-80 reference steels and 11 experimental steels are listed in Table 1 as follows:

TABLE 1

| Steel | Characteristic | Composition of Experimental Steels, Element, % | | | | | | | | | |
|---|---|---|---|---|---|---|---|---|---|---|---|
| | | C | Mn | Si | Mo | Nb | V | N | Al | P | S |
| | | Quenched-and-Tempered Type | | | | | | | | | |
| N-80(I) | Commercial | 0.25 | 1.25 | 0.16 | — | — | — | 0.0038 | 0.018 | 0.010 | 0.022 |
| A | 0.20C—0.10Mo | 0.20 | 1.25 | 0.19 | 0.096 | — | — | 0.0047 | 0.019 | 0.009 | 0.022 |
| B | 0.20C—0.15Mo | 0.20 | 1.26 | 0.19 | 0.14 | — | — | 0.0042 | 0.026 | 0.010 | 0.022 |
| C | 0.15C—0.10Mo | 0.15 | 1.25 | 0.15 | 0.10 | — | <0.005 | 0.0074 | 0.016 | 0.010 | 0.022 |
| D1 | 0.10C—0.10Mo—Nb | 0.10 | 1.25 | 0.20 | 0.094 | 0.050 | — | 0.0042 | 0.028 | 0.010 | 0.022 |
| D2 | 0.15C—0.10Mo—Nb | 0.15 | 1.25 | 0.21 | 0.095 | 0.049 | — | 0.0042 | 0.025 | 0.008 | 0.022 |
| E | 0.15C—0.10Mo—V | 0.15 | 1.25 | 0.18 | 0.098 | — | 0.10 | 0.0080 | 0.010 | 0.008 | 0.022 |
| F | 0.15C—0.20Mo | 0.15 | 1.25 | 0.20 | 0.20 | — | — | 0.0041 | 0.020 | 0.009 | 0.021 |
| | | Normalized Type | | | | | | | | | |
| N-80(II) | Commercial V—N* | 0.34 | 1.31 | 0.24 | — | — | 0.10 | 0.0160 | 0.018 | 0.013 | 0.022 |
| G | 0.30C—0.10Mo | 0.30 | 1.35 | 0.29 | 0.10 | — | — | 0.0041 | 0.011 | 0.012 | 0.023 |
| H | 0.30C—0.20Mo | 0.31 | 1.40 | 0.28 | 0.21 | — | — | 0.0042 | 0.027 | 0.010 | 0.024 |
| I | 0.30C—0.30Mo—V—N* | 0.30 | 1.30 | 0.27 | 0.30 | — | 0.10 | 0.0156 | 0.015 | 0.012 | 0.022 |
| J | 0.30C—0.20Mo—Nb | 0.31 | 1.40 | 0.28 | 0.20 | 0.052 | — | 0.0042 | 0.025 | 0.010 | 0.024 |

*vanadium-nitrogen heats

Hot Working

The ingots were upset-forged at 2300° F. (1260° C.) to slabs about 5 in. (125 mm) square and 3 in. (75 mm) thick. The slabs were reheated to 2300° F. (1260° C.) and rolled to 1.25 in. (32 mm) thick plate. Following the removal of stock for a Jominy specimen, the plates were reheated to 2000° F. (1090° C.) and rolled to 0.8 in. (20 mm) for the Q & T type steels and 0.4 and 0.6 in. (10 and 15 mm) for normalized steels. (These thicknesses are twice as heavy as the wall thicknesses of the tubulars they were intended to represent because plates cool from two sides while ERW tubulars cool only from the outside.)

Heat Treating

To ensure that results obtained would be applicable to commercial production of ERW casing and tubing, special techniques were employed to achieve heating and cooling rates corresponding to those experienced in production.

Simulated Coil-Cooling

The plates were annealed to simulate the hot coiling and slow cooling of ERW hot band. The plates were held for 1 hour at 1650° F. (900° C.). Power was reduced to a low level, and the plates were cooled slowly through the transformation range as shown in FIG. 1 which depicts the cooling curve of the plates. The slope of the cooling curve at 1300° F. (705° C.) was −1.4 F./min (−0.8 C./min). When the plates reached 1150° F. (620° C.), furnace power was turned off and the plates cooled somewhat more rapidly to room temperature.

Normalizing

All of the plates and Jominy blanks were given a normalizing treatment simulating rapid full-body normalizing. The plates, three or four at a time, and the Jominy blanks in a separate set, were placed in a large circulating air furnace held at 1700° F. (925° C.). This procedure caused fairly rapid heating of the charge, FIG. 2. The plates or Jominy specimens were held at temperature for 5 minutes and were removed and allowed to cool in still air.

Simulated Induction Hardening and Induction Tempering

To simulate the rapid heating and the brief time at the austenitizing temperature experienced during induction hardening of ERW tubulars, sections of each plate were heated to 1200° F. (650° C.) then transferred to a large furnace that was maintained at a temperature 100° F. (55° C.) above the desired austenitizing temperature. A thermocouple located at mid-thickness of the plate was used to monitor temperature. Each plate was quenched in an agitated 10% brine solution within 15 seconds after reaching the desired austenitizing temperature. Preliminary tests showed that the Q $ T reference steel (the N-80 steel) did not fully harden when austenitized at temperatures of 1800° F. (980° C.) and 1900° F. (1035° C.); hardness values in the center of 0.8 in. (20 mm) thick plates were 15 and 20 HRC, respectively. Raising the austenitizing temperature to 2000° F. (1095° C.) improved the hardening of the reference steel; the plate hardness increased to 39 HRC. Thus, all of the Q & T steels were quenched from 2000° F. (1095° C.). The simulated induction hardening operation is represented in FIG. 2.

Tensile specimen blanks 7/16 by 0.8 by 3.6 in. (11 by 20 by 90 mm), from each as-quenched plate were subjected to a simulated induction tempering treatment. For each tempering condition, a circulating air preheating furnace was set 200° F. (110° C.) below, and a salt bath 100° F. (55° C.) above the desired peak tempering temperature. The two wires of a chromelalumel thermocouple were spot-welded individually to opposite sides of one tensile specimen blank. This specimen together with no more than two others were preheated and then transferred to the salt bath. As soon as the thermocouple indicated that the blanks had reached the desired peak tempering temperature (typically after about 1 minute in the salt baths), the specimens were removed and cooled in still air. A typical time-temperature curve during tempering is shown in FIG. 2. It should be noted that a preliminary test of an instrumented blank revealed that the interior of the piece lagged the surface by 11° F. (6° C.) at the moment the peak temperature was attined. This correction was applied to all tempering treatments.

Mechanical Testing

The hardness and room temperature tensile properties were measured for all steels in both the furnace-cooled and the normalized conditions and for the Q & T steels in the quenched and tempered condition. Longitudinal tensile blanks were taken from near the center of each plate at the midthickness location. The midthickness specimen location is particularly important for the 0.8 in. (20 mm) Q & T steels because it simulates the inner surface of 0.4 in. (10 mm) wall casing, the most difficult location to harden during an external quench. Round tensile specimens having a gauge diameter of 0.250 in. (6.35 mm) and a gauge length of 1 in. (25 mm) were machined from all tensile blanks. Testing was performed at strain rates of 18 and 300%/hr in the elastic and plastic ranges, respectively, and followed the guideline of ASTM Method A 370-77. Yield strengths were measured by the 0.2% offset method. In most cases there was no significant difference between these values and yield strengths measured at 0.5% total strain as specified for API grades of tubulars.

TRANSFORMATION STUDIES

Jominy Tests

Jominy specimens of all eight Q & T steels were end-quenched in a standard fixture in accordance, except for the austenitizing conditions, with ASTM Method A 255-67. Rather than the conventional austenitizing treatment, the Jominy blanks were subjected to the simulated induction austenitizing as described earlier. The austenitizing temperature was 2000° F. (1095° C.).

Continuous Cooling Transformation Tests

The continuous cooling transformation (CCT) behavior of three normalized steels was determined with a quenching dilatometer. Dilatometer test specimen design used for Steels N-80(II), G, and H were a hollow cylinder 0.4 in. (10 mm) in length and 0.2 in. (5 mm) in outside diameter with a 0.12 in. (3 mm) diameter hole. One specimen of each steel was heated at 3.6 F./min (2 C./min) from 1110° to 1760° F. (600° to 960° C.) to determine the $Ac_1$ and $Ac_3$ temperatures. Specimens of each steel were individually heated rapidly and austenitized at 1700° F. (925° C.), held 5 minutes, and then cooled at one of ten rates. From the curve of temperature versus length during cooling and aided by metallographic examination and hardnesses, the CCT diagrams for the three steels were constructed.

Metallography

Conventional mechanical polishing and etching techniques were employed for metallographic studies of the steels in various conditions. Specimens were examined optically and in a scanning electron microscope.

RESULTS OF THE TESTS

Quenched and Tempered Steels

Simulated Hot band

Figure 3A:
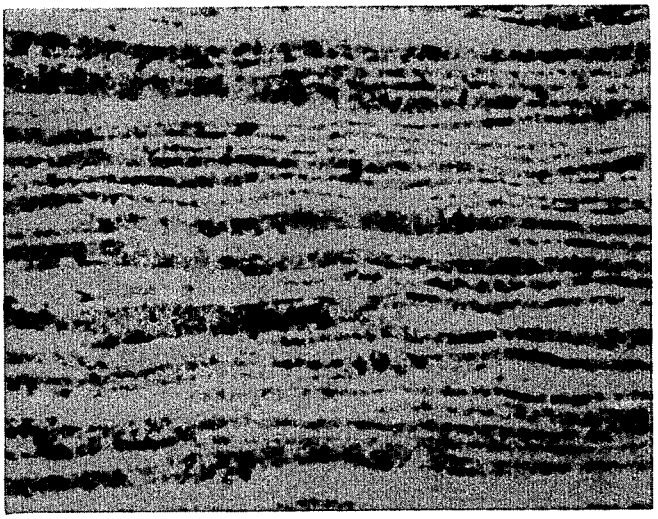
Figure 3B:
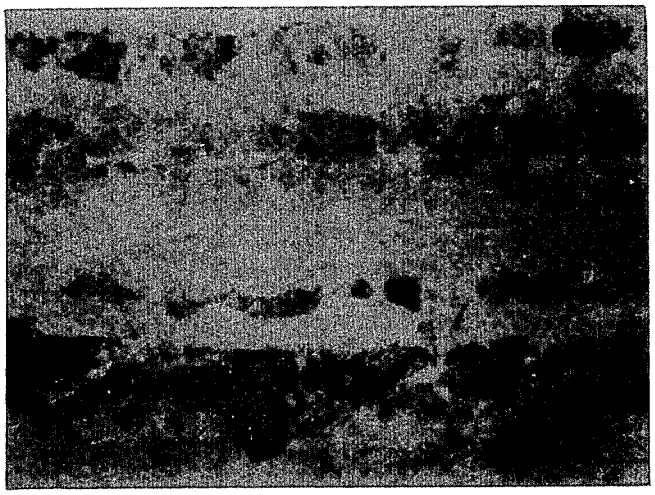
Figure 4A:
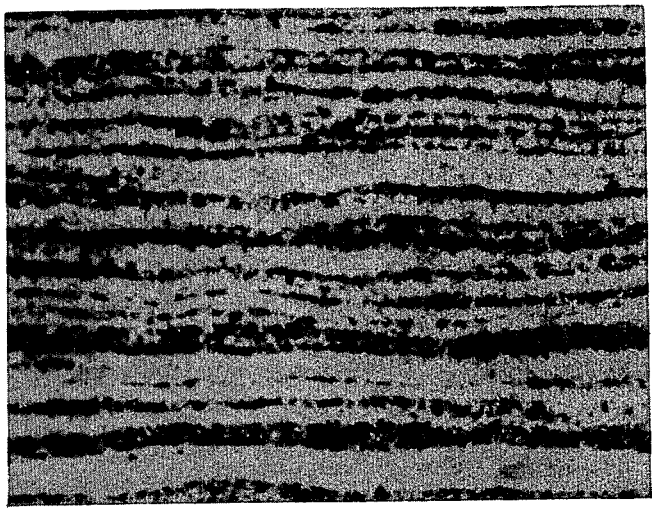
Figure 4B:
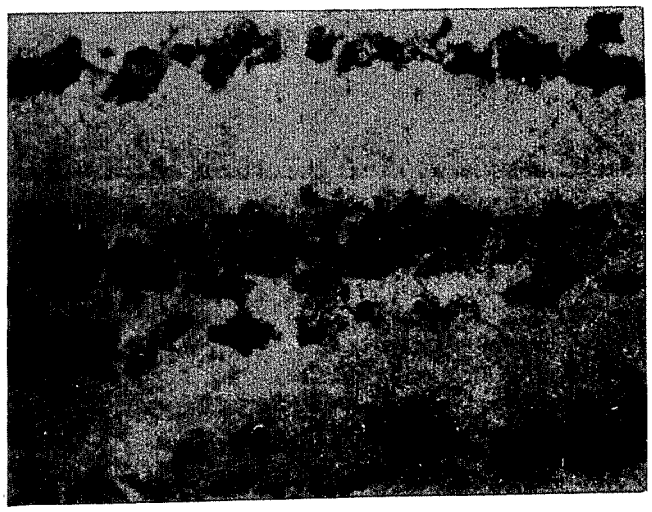
Figure 5A:
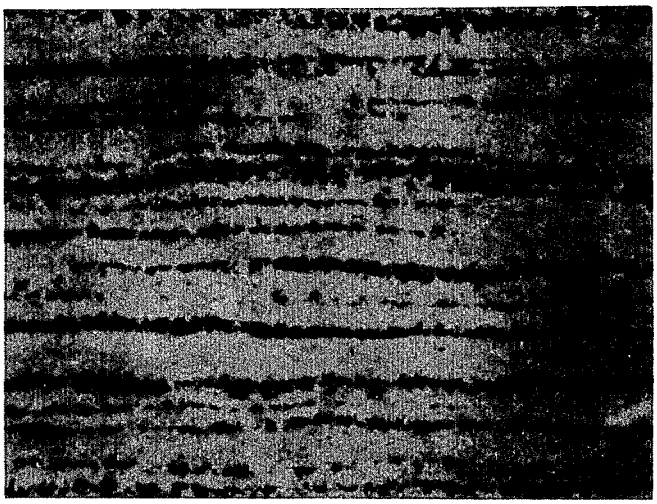
Figure 5B:
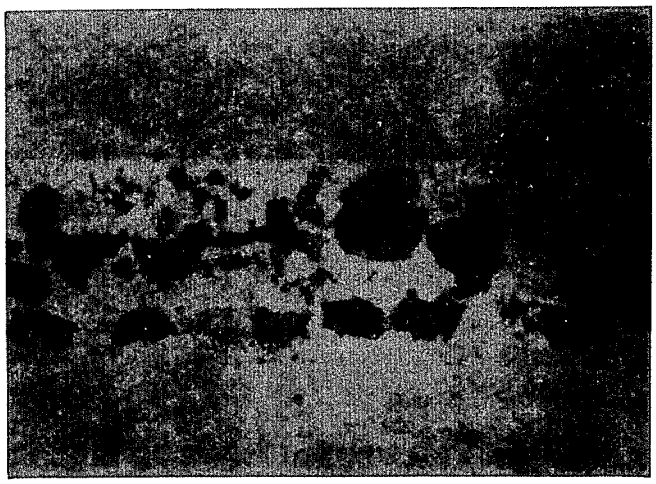
Figure 6A:
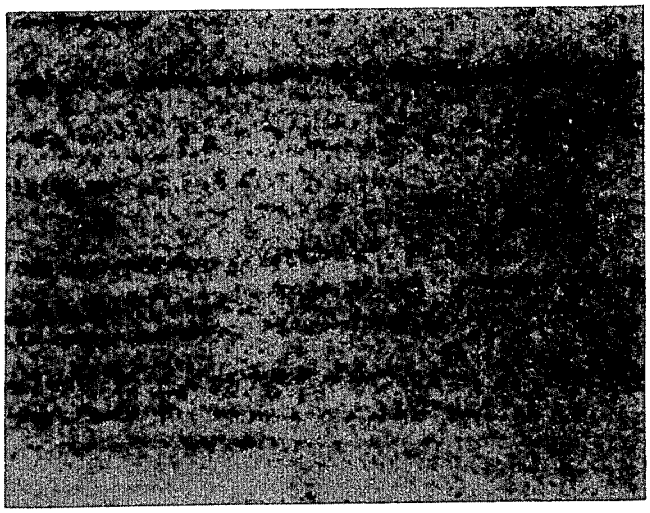
Figure 6B:
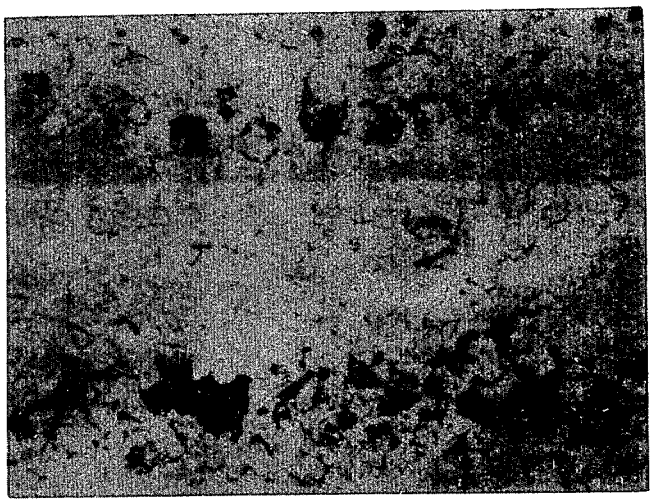
Figure 9A:
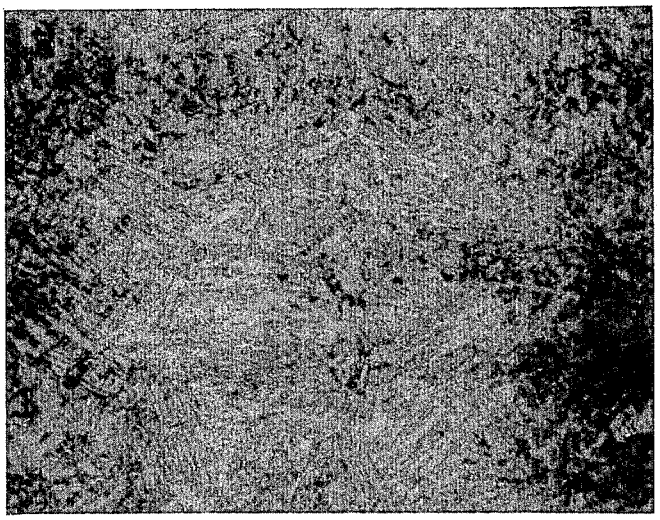
Figure 9B:
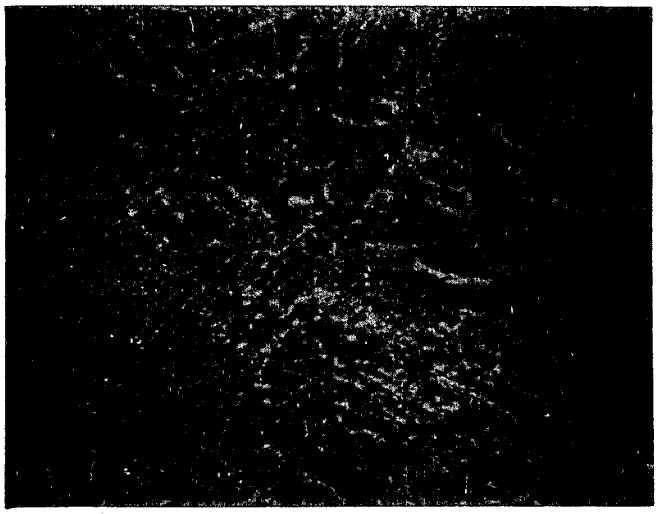
Figure 10A:
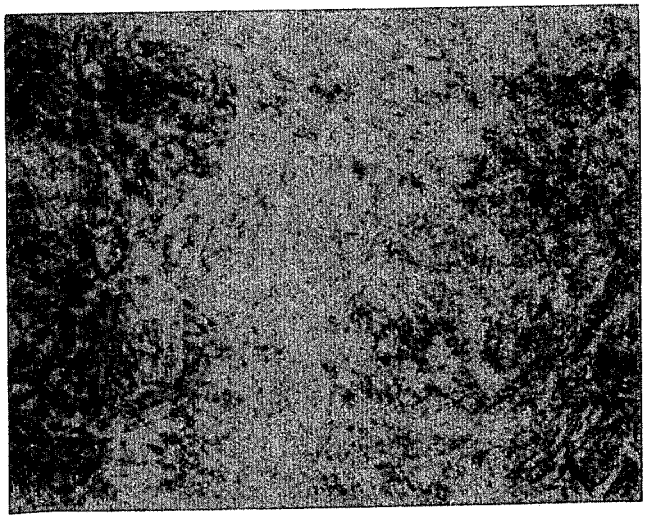
Figure 10B:
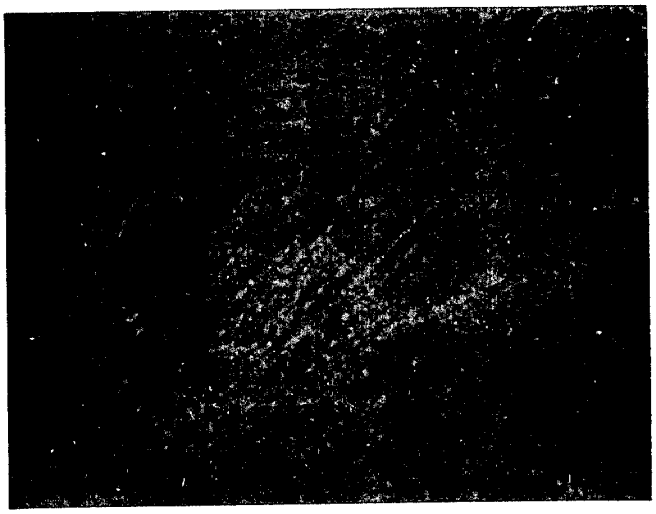
Figure 11A:
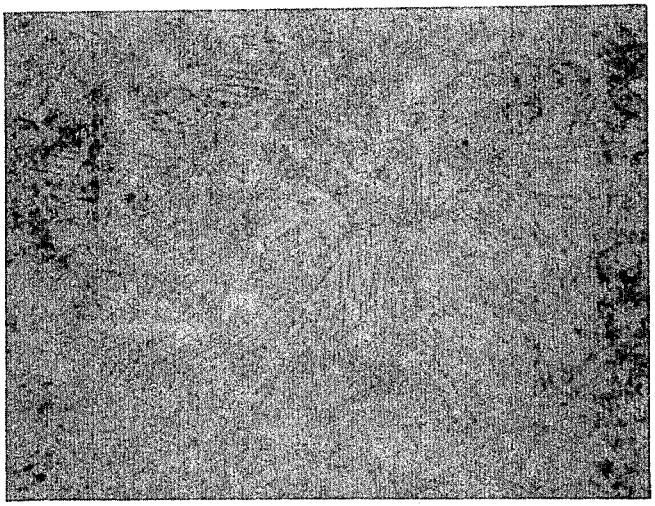
Figure 11B:
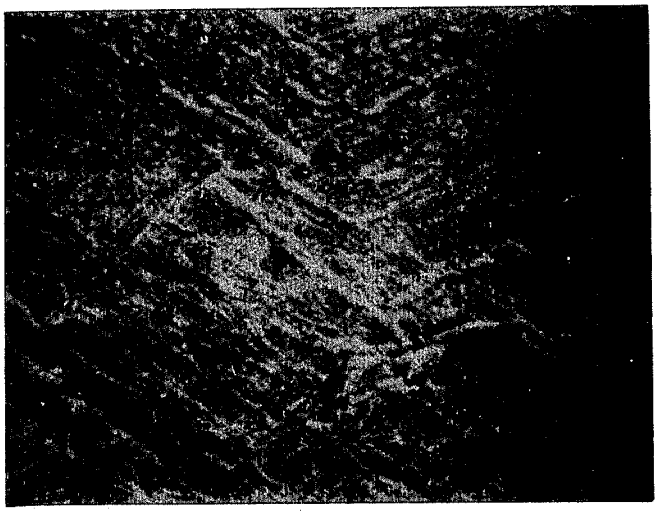
Figure 12A:
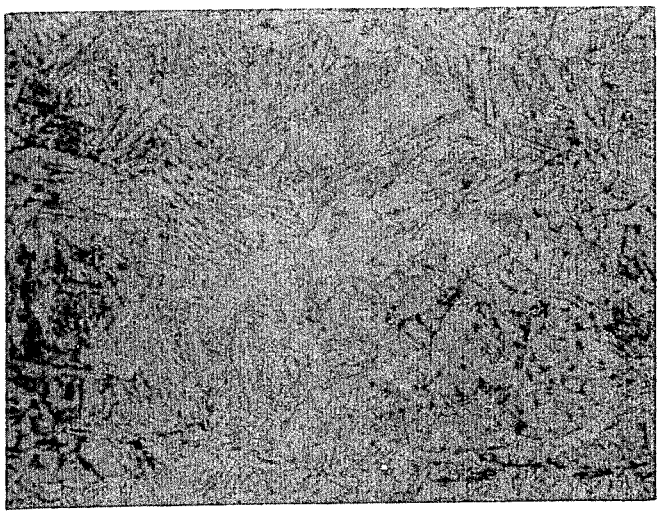
Figure 12B:
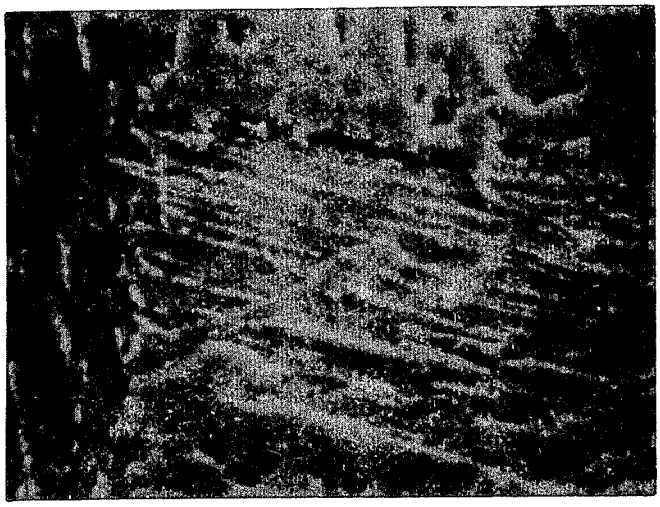
Figure 13A:
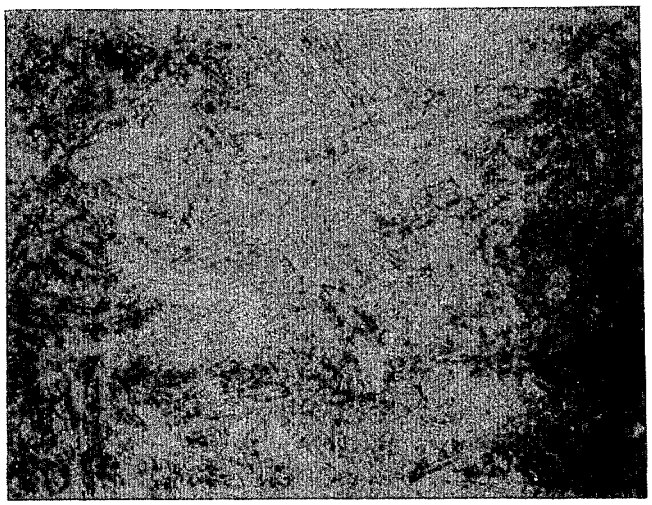
Figure 13B:
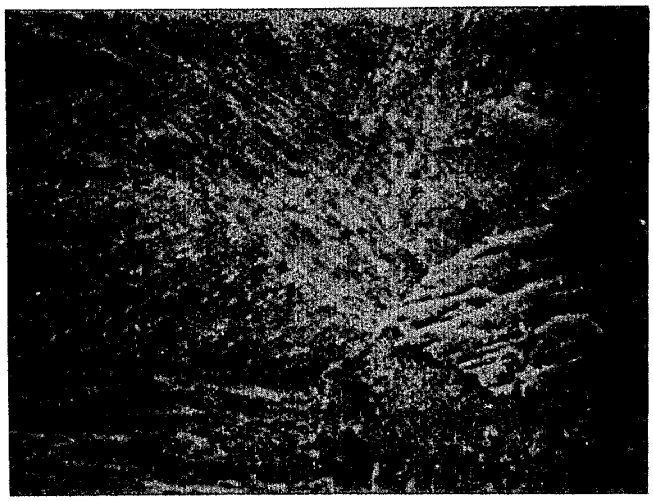

The hot band steel for N-80 ERW casing typically has a microstructure of proeutectoid ferrite and pearlite. For example, the microstructure of the 0.25% C reference steel [N-80(I)] is shown in FIG. 3 (comprising FIGS. 3*a* and 3*b*). As is typical for slowly cooled steels, there is pronounced banding. Significantly less pearlite is observed at the successively lower carbon levels of the experimental Q & T steels, as illustrated in FIGS. 4, 5 and 6 (comprising FIGS. 4*a*, 4*b*, 5*a*, 5*b*, 6*a* and 6*b*). Steel D1, with only 0.10% C, contains very little pearlite and, because of its niobium content, exhibits the finest ferrite grain size of the four Q & T experimental steels.

Hardness and tensile properties of the steels in the simulated hot band condition are presented in Table 2. With few exceptions, hardness values of the experimental steels are lower than for the reference steel. Yield and tensile strengths are also depicted graphically in FIG. 7. The measured yield strength of the reference steel is 45 ksi (310 MPa) which is somewhat lower than expected suggesting that the hot band simulation imposed cooling rates lower than those of commercial practice. However, reasonable comparisons of strength and ductility may be made among the steels. Three of the experimental steels, C, D1, and F have yield strengths significantly below that of the reference steel. The lowest yield strength, 39 ksi (270 MPa) for Steel C (0.15C-0.10Mo) reflects a reduced pearlite content. The fact that 0.10% C Steel D1 has a higher yield strength than 0.15% C Steel C is attributed to the fine grain size of Steel D1. Reference Steel N-80(I) has a tensile strength of 74 ksi (505 MPA) in the simulated hot band condition. As shown in FIG. 7, the tensile strengths of all seven experimental steels are lower than that of N-80(I). The elongation and reduction of area values of the experimental steels are substantially greater than those of the reference steel. The lower strength and improved ductility of the experimental steels indicate that they should be easier to form than the conventional Q & T N-80 steel.

TABLE 2

Hardness and Tensile Properties of Q&T Steels in the Simulated Hot Band Condition

| | Hardness | | | Tensile Properties | | | | | |
|---|---|---|---|---|---|---|---|---|---|
| | | | | 0.2% Offset Yield Strength, | | Tensile Strength, | | | |
| Steel | HB | HRA | HRB | ksi | (MPa) | ksi | (MPa) | Elongation, % | Reduction of Area, % |
| N-80(I) | 135 | 45.4 | 74.9 | 44.6 | (307) | 73.5 | (507) | 33.5 | 62.0 |
| A | 127 | 44.1 | 72.2 | 43.4 | (299) | 70.5 | (486) | 38.0 | 65.5 |
| B | 129 | 44.1 | 73.4 | 44.1 | (304) | 70.5 | (486) | 40.5 | 65.5 |
| C | 115 | 41.1 | 66.8 | 39.4 | (271) | 63.4 | (438) | 39.0 | 67.5 |
| D1 | 118 | 42.0 | 68.3 | 42.0 | (289) | 61.0 | (420) | 44.0 | 77.0 |
| D2 | 118 | 43.0 | 70.5 | 43.2 | (298) | 64.7 | (446) | 43.5 | 72.0 |
| E | 124 | 43.9 | 72.3 | 44.9 | (309) | 66.8 | (460) | 42.0 | 70.0 |
| F | 116 | 41.9 | 67.9 | 40.8 | (281) | 63.9 | (440) | 42.0 | 70.5 |

Hardenability

The hardenabilities of the steels subjected to simulated induction heating are represented in the Jominy curves in FIG. 8 (comprising FIGS. 8*a*, 8*b* and 8*c*). Reflecting its high carbon content, N-80(I) has the highest maximum hardness, 46 HRC. Based on the relationships between hardness, carbon content, and percent martensite developed by Hodge and Orehoski,[1] the reference steel was quenched to 99% martensite at the quenched end. As carbon content is lowered to 0.20, 0.15, and 0.10%, the maximum hardness values decline to 43, 39, and 36 HRC, respectively, reflecting the lower carbon contents of the fully hardened structures.

[1]J. M. Hodge and M. A. Orehoski, "Relationship Between Hardenability and Percentage of Martensite in Some Low Alloy Steels," J. AIME, 167 (1046), p. 627.

The positions of the inflection points in the Jominy curves illustrate the strong effect of carbon on hardenability. The addition of 0.10 to 0.15% Mo is sufficient to counteract a reduction in the carbon content from 0.25% to 0.20% [cf. Steels A and B versus Steel N-80(I)]. Reducing the carbon content further to 0.15% cannot be made up by even 0.20% Mo (Steel F). A vanadium addition (Steel E) has a detrimental effect on hardenability where it matters, that is, near the quenched end. The hardness of the vanadium steel is relatively high at the slowly cooled end of the Jominy curve. Vanadium impairs the hardenability of the rapidly austenitized steels probably as a consequence of the relatively sluggish dissolution rates of vanadium carbides. The lowest hardenabilities are exhibited by the two niobium-containing steels D1 and D2, presumably as a result of the grain refinement effect of niobium.

Quenched and Tempered Condition

Hardnesses of the Q & T steels in the as-quenched condition are reported in Table 3. The reference steel and Steel B had sufficient hardenability to transform to more than 90% martensite. Steels A and F contained only 70 to 80% martensite in the quenched condition, and the others contained less than 50% martensite. The microstructures of quenched specimens on the basis of hardness were confirmed by observation.

TABLE 3

Hardness and Martensite Content[a] of Q&T-Type Steels in the As-Quenched Condition

| Steel | Nominal Composition | Midthickness[b] Plate Hardness, HRC | Martensite Content, % |
|---|---|---|---|
| N-80(I) | 0.25C | 42 | 90 |
| A | 0.20C—0.10Mo | 36.5 | 80 |
| B | 0.20C—0.15Mo | 40 | 95 |
| C | 0.15C—0.10Mo | 26 | <50 |
| D1 | 0.10C—0.10Mo—Nb | 20 | <<50 |
| D2 | 0.15C—0.10Mo—Nb | 22 | <<50 |
| E | 0.15C—0.10Mo—V | 27.5 | <50 |
| F | 0.15C—0.20Mo | 32 | 70 |

[a]Based on published relationship between steel carbon content, as-quenched hardness, and martensite content of low alloy steels (Reference 1).
[b]This location corresponds to the inner surface of externally quenched 0.4 in. (10 mm) wall casing.

Microstructures of the quenched and tempered specimens of the reference steel and some of the experimental steels are shown in FIGS. 9 through 13 (comprising FIGS. 9*a*, 9*b*, 10*a*, 10*b*, 11*a*, 11*b*, 12*a*, 12*b*, 13*a* and 13*b*). These micrographs are from samples that had been tempered at 1300° F. (705° C.). The heat treatment of the test specimens simulated the relatively slowly cooled I.D. position of externally water quenched 0.4 in. (10 mm) wall casing, so some bainite formed in all steels. The smallest amount of bainite formed in the reference steel (FIGS. 9*a* and 9*b*) and in Steel B (0.20C-0.15Mo, FIG. 10). Steel C (0.15C-0.10Mo, FIGS. 11*a*, 11*b*) is predominantly bainite, while Steel D1 (0.10C-0.10Mo-0.05Nb), FIG. 12) contains polygonal ferrite, bainite, and some acicular ferrite. The carbides in the two higher molybdenum steels (B and F, FIGS. 10*a*, 10*b* and 13*a*, 13*b*) appear to be finer than in the steels of lower molybdenum content.

Hardness and tensile properties as a function of tempering temperature of the Q & T steels are presented in Table 4 and FIGS. 14 and 15. Hardness generally declines from the quenched values into the range from 25 to 15 HRC as tempering temperature increases. Yield strengths generally span the specified range for N-80, 80 to 110 ksi (550 to 760 MPa). Tensile strengths have the same tempering response as yield strengths, but average about 15 ksi (100 MPa) higher than the latter. Elongations trend upward from about 20 to 30% and reductions of area similarly increase from about 60 to about 70% as tempering temperatures increase. It is noted that Steels D1 and D2 have very low hardness, yield, and tensile strengths reflecting the fact that these steels were mainly bainitic after quenching. The presence of vanadium in Steel E retards tempering.

TABLE 4

Hardness and Tensile Properties of Q&T Steels in the Simulated Induction Heat Treated Condition[a]

| Steel | Peak Tempering Temperature, F. | (C.) | Hardness HRC | Tensile Properties: 0.2% Offset Yield Strength, ksi | (MPa) | Tensile Strength, ksi | (MPa) | El., % | R.A., % |
|---|---|---|---|---|---|---|---|---|---|
| N-80(I) | 1000 | (540) | 28.1 | 115.5 | (796) | 129.4 | (892) | 19.5 | 63.0 |
| | 1100 | (595) | 24.4 | 102.9 | (709) | 120.2 | (829) | 23.5 | 65.0 |
| | 1125 | (605) | 22.7 | 95.4 | (658) | 115.0 | (793) | 22.5 | 66.0 |
| | 1250 | (675) | 19.9 | 88.4 | (609) | 107.9 | (744) | 25.5 | 70.5 |
| | 1300 | (705) | 14.4 | 73.6 | (507) | 96.0 | (662) | 27.5 | 72.0 |
| A | 1100 | (595) | 22.9 | 104.0 | (717) | 120.1 | (828) | 21.0 | 66.5 |
| | 1125 | (605) | 24.9 | 103.3 | (712) | 118.6 | (818) | 22.5 | 67.0 |
| | 1250 | (675) | 22.8 | 95.2 | (656) | 112.0 | (772) | 23.5 | 69.0 |
| | 1300 | (705) | 19.9 | 90.5 | (624) | 106.3 | (733) | 23.5 | 67.5 |
| | 1400 | (760) | 12.3 | 68.5 | (472) | 92.2 | (636) | 30.5 | 69.0 |

TABLE 4-continued

Hardness and Tensile Properties of Q&T Steels in the Simulated Induction Heat Treated Condition[a]

| Steel | Peak Tempering Temperature, F. | (C.) | Hardness HRC | Tensile Properties: 0.2% Offset Yield Strength, ksi | (MPa) | Tensile Strength, ksi | (MPa) | El., % | R.A., % |
|---|---|---|---|---|---|---|---|---|---|
| B | 1100 | (595) | 27.3 | 115.4 | (796) | 127.8 | (881) | 20.5 | 65.5 |
| | 1125 | (605) | 26.3 | 111.5 | (769) | 124.2 | (856) | 21.0 | 67.0 |
| | 1250 | (675) | 23.2 | 101.4 | (699) | 115.6 | (797) | 24.0 | 70.0 |
| | 1300 | (705) | 21.4 | 100.1 | (690) | 114.5 | (789) | 22.5 | 69.5 |
| | 1400 | (760) | 14.3 | 72.8 | (502) | 95.6 | (659) | 28.5 | 71.0 |
| C | 900 | (480) | 24.9 | 99.9 | (689) | 120.7 | (832) | 19.5 | 63.5 |
| | 1100 | (595) | 19.4 | 86.7 | (598) | 105.8 | (729) | 23.0 | 67.5 |
| | 1200 | (650) | 15.5 | 78.7 | (542) | 98.2 | (677) | 26.5 | 71.0 |
| | 1300 | (705) | 13.5 | 76.9 | (530) | 95.2 | (656) | 27.5 | 72.5 |
| D1 | 800 | (425) | 18.6 | 84.0 | (579) | 100.2 | (691) | 22.0 | 74.0 |
| | 900 | (480) | 14.1 | 74.7 | (515) | 93.8 | (647) | 23.5 | 76.0 |
| | 1000 | (540) | 13.9 | 78.0 | (538) | 95.0 | (655) | 24.0 | 75.5 |
| | 1000 | (540) | 13.4 | 75.6 | (521) | 92.5 | (638) | 28.5 | 77.0 |
| | 1100 | (595) | 11.4 | 72.0 | (496) | 88.5 | (610) | 28.0 | 76.0 |
| | 1200 | (650) | 9.4 | 71.7 | (494) | 87.5 | (603) | 31.0 | 75.5 |
| | 1300 | (705) | 10.2 | 72.8 | (502) | 86.9 | (599) | 31.5 | 77.5 |
| D2 | 800 | (425) | 19.9 | 82.0 | (565) | 105.4 | (727) | 22.5 | 72.0 |
| | 900 | (480) | 17.3 | 81.0 | (558) | 101.4 | (699) | 23.0 | 73.0 |
| | 1000 | (540) | 19.7 | 88.4 | (609) | 104.0 | (717) | 23.0 | 71.5 |
| | 1100 | (595) | 14.9 | 73.5 | (507) | 93.3 | (643) | 25.0 | 72.0 |
| | 1200 | (650) | 13.3 | 71.4 | (492) | 90.1 | (621) | 24.0 | 72.0 |
| | 1300 | (705) | 12.8 | 73.0 | (503) | 91.3 | (620) | 27.0 | 72.0 |
| E | 1000 | (540) | 21.8 | 96.5 | (665) | 114.0 | (786) | 19.0 | 69.0 |
| | 1100 | (595) | 22.1 | 97.9 | (675) | 110.8 | (764) | 22.0 | 66.0 |
| | 1200 | (650) | 21.7 | 94.1 | (649) | 109.4 | (754) | 20.5 | 67.0 |
| | 1300 | (705) | 22.8 | 102.2 | (704) | 117.6 | (811) | 24.5 | 70.0 |
| | 1400 | (760) | 16.2 | 80.6 | (556) | 98.0 | (676) | 24.5 | 70.0 |
| F | 1000 | (540) | 26.5 | 111.5 | (769) | 125.8 | (867) | 17.5 | 67.5 |
| | 1100 | (595) | 24.2 | 104.1 | (718) | 115.9 | (867) | 21.0 | 69.0 |
| | 1200 | (650) | 20.3 | 91.6 | (631) | 106.1 | (731) | 25.5 | 71.5 |
| | 1300 | (705) | 17.0 | 85.6 | (590) | 100.8 | (695) | 24.5 | 72.5 |
| | 1400 | (760) | 12.1 | 73.2 | (505) | 90.6 | (625) | 24.5 | 74.0 |

Because L-80 and N-80 specifications are based on yield strength, curves of yield strength versus tempering temperature for eight Q & T steels are shown in FIG. 16. The yield strength of the 0.25% C reference steel, N-80(I), decreases sharply as the tempering temperature increases, and tempering must be performed below 1265° F. (685° C.) to assure attainment of 80 ksi (550 MPa) minimum yield strength. The addition of molybdenum imparts tempering resistance to the steels. For example, the yield strength of Steel A (0.20C-0.10Mo) is virtually the same as or higher than the yield strength of the higher carbon reference steel at all temperatures that provide 80 to 110 ksi (550 to 760 MPa). Increasing molybdenum content to 0.15% (Steel B) gives even more tempering resistance and higher strength at a given tempering temperature. The tempering curve for Steel C (0.15C-0.10Mo) is appreciably lower, but increasing the molybdenum content to 0.20% (Steel F) raises the curve for a 0.15% C steel almost to the level of Steel A (0.20C-0.10Mo). The secondary hardening effect of vanadium may be seen in the curve for Steel E (0.15C-0.10Mo-0.10V). Steel D2 (0.15C-0.10Mo-0.05Nb) lies below the N-80 yield strength range at all tempering temperatures above about 900° F. (480° C.). The yield strength curve is lowered only slightly in such a niobium-containing steel by reducing the carbon content to 0.10%.

One of the advantages of the experimental steels is the lower slopes of the yield strength curves in FIG. 16 relative to that of the reference steel. For example, the temperature range over which N-80 yield strengths are achieved is 215° F. (120° C.) for Steel N-80(I), 335° F. (200° C.) for Steel A, 240° F. (135° C.) for Steel B, and 325° F. (185° C.) for Steel F. The comparable tempering temperature ranges for L-80 properties are 105° F. (58° C.) for Steel N-80(I), 135° F. (75° C.) for Steel A, 65° F. (35° C.) for Steel B, and 160° F. (90° C.) for Steel F. Because the experimental molybdenum-alloyed steels generally exhibit wider temperature ranges for attainment of specified L-80 and N-80 strengths, they are less susceptible to unavoidable variations in tempering conditions during the heat treating of tubulars.

SUMMARY

The objectives of reducing hot band strength and increasing ductility to improve formability of hot band for heavy-walled ERW casing were realized by reducing the carbon content of a manganese steel. Hardenability can be balanced by the addition of small amounts of molybdenum, but niobium and vanadium additions are detrimental to hardenability. The Mn-Mo steels are generally less sensitive to variations in tempering temperatures than the manganese steel, suggesting greater control in the mill tempering operation. Promising compositions for L-80 and N-80 casing steels indicated by the study are 0.20% C, 1.25% Mn, 0.10/0.15% Mo and 0.15% C, 1.25% Mn, 0.15/0.20% Mo.

NORMALIZED STEELS

Simulated Hot Band

Because the normalized steels were studied in two plate thicknesses representing 0.2 and 0.3 in. (5 and 7.5 mm) wall tubing, the hot band simulation was conducted for each. Somewhat different results were observed for the two plate thicknesses; the thicker plates generally exhibited lower hardnesses and strengths plus higher ductilities than the thinner plates, as reported in Table 5. This behavior is believed to be due to the fact that the simulations were performed at different times with slightly different conditions. Nevertheless, comparisons within the group of the steels tested illustrate the relative effects of the various alloying elements. The simulated hot band strengths drop sharply when the 0.10% V in the reference steel is replaced by 0.10% Mo and the carbon and nitrogen contents are reduced [cf. Steel G and Steel N-80(II)]. Increasing the molybdenum content from 0.10% (Steel G) to 0.20% (Steel H) returns the hot band properties to the same level as in the reference steel. When vanadium is added to a 0.30C-0.30Mo steel having a high nitrogen content (Steel I), hot band strengths become quite high although ductility is only slightly reduced compared with the reference steel. Adding niobium to a 0.30C-0.20Mo steel (Steel J) also boosts the hot band yield and tensile strengths slightly above those of the reference steel. In summary, three of the experimental steels have yield and tensile strengths that are about the same or lower than that of the N-80(II) reference steel; only Steel I has notably higher yield and tensile strength.

TABLE 5

Hardness and Tensile Properties of Normalized-Type Steels in the Simulated Hot Band Condition

| Steel | Hardness HB | Hardness HRA | Hardness HRB | Tensile Properties: 0.2% Offset Yield Strength, ksi | (MPa) | Tensile Strength, ksi | (MPa) | Elongation, % | Reduction of Area, % |
|---|---|---|---|---|---|---|---|---|---|
| | | | | 10 mm (0.4 in.) Plate | | | | | |
| N-80(II) | 162 | 50.9 | 84.4 | 53.7 | (370) | 85.9 | (592) | 33.0 | 61.5 |
| G | 150 | 48.5 | 80.1 | 45.7 | (315) | 81.5 | (562) | 28.0 | 56.0 |
| H | 163 | 51.0 | 84.2 | 53.4 | (368) | 86.1 | (593) | 28.0 | 60.0 |
| I | 172 | 52.8 | 87.6 | 62.0 | (427) | 90.2 | (622) | 28.0 | 57.5 |
| J | 163 | 51.5 | 85.3 | 58.1 | (400) | 86.0 | (593) | 31.0 | 63.0 |
| | | | | 15 mm (0.6 in.) Plate | | | | | |
| N-80(II) | 148 | 51.6 | 82.9 | 52.8 | (364) | 84.6 | (583) | 33.0 | 59.0 |
| G | 140 | 50.1 | 79.0 | 44.2 | (305) | 80.6 | (556) | 32.5 | 54.5 |
| H | 149 | 49.2 | 82.0 | 50.8 | (350) | 84.3 | (581) | 34.0 | 59.5 |
| I | 160 | 49.6 | 85.4 | 59.5 | (410) | 88.0 | (607) | 32.0 | 58.0 |
| J | 149 | 49.5 | 82.1 | 55.1 | (380) | 83.8 | (578) | 34.5 | 59.5 |

Phase Transformations

The normalized N-80 steels exhibit phase transformation characteristics typical of low alloy medium carbon steels. The continuous cooling transformation (CCT) diagrams for N-80(II), Steel G and Steel H are presented in FIGS. 17–19. The upper band in the high temperature transformation product region represents polygonal ferrite formation. Also shown on each diagram is the cooling curve of the normalized 0.4 in. (10 mm) plate that was used to simulate the cooling of 0.2 in. (5 mm) wall tube as it cools from the normalizing temperature. The transformation to polygonal ferrite begins at relatively high temperatures and short times for N-80(II). At cooling rates representative of normalized tubing, FIG. 17 shows that pearlite formation is complete when the temperature reaches 1105° F. (595° C.).

The CCT curves for Steel G (FIG. 18) and the reference steel are significantly different. Compared to Steel N-80(II), the nose of the high temperature transformation zone for Steel G is at greater times and extends over a broader and lower temperature range. During the cooling at rates representative of normalized tubing, transformation continues until considerably lower temperatures than in N-80(II). For example, at the cooling rate typical of 0.2 in. (5 mm) wall tubing, transformation is not complete until 885° F. (475°C.). The transformation products are mostly polygonal ferrite and pearlite, but some acicular ferrite and bainite also form. Because Steel G contains less carbon than the reference steel and is not VN-strengthened, the hardness for the simulated tubing cooling rate is slightly below that of simulated N-80(II).

Raising the molybdenum content to 0.20% (Steel H, FIG. 19) delays virtually all stages of transformation during continuous cooling and extends the range for partial martensite formation to slower cooling rates. The cooling curve of the 0.2 in. (5 mm) wall tubing indicates less formation of polygonal ferrite and pearlite and more formation of acicular ferrite and bainite; the completion of bainite formation is suppressed to 850° F. (450°C.). Because of these changes in microstructure, the indicated hardness for Steel H cooled to simulate 0.2 in. (5 mm) wall tubing was the highest of the three steels for which CCT curves were established.

Normalized Condition

Microstructures of three representative steels in the normalized condition are shown in FIGS. **20*a*, 20*b*, and 20*c***. Steel N-80(II) exhibits a ferrite-pearlite structure, with the ferrite being polygonal in morphology and mixed in size. This variation in the ferrite grain size stems from a very wide range of prior-austenite grain size that was evident in metallographically examined CCT specimens. Segregation of vanadium probably caused the grain refining effect of vanadium to change markedly from point to point in the reference steel. Removing the vanadium (Steel G) results in considerably coarser polygonal ferrite. Moreover some acicular ferrite is evident in the 0.10% Mo steel. Raising the molybdenum content to 0.20% (Steel H) markedly reduces the quantity of polygonal ferrite and promotes a structure consisting largely of acicular ferrite. A study of metallographic specimens of Steel H water quenched from different temperatures [1200°–700° F. (650°–370° C.) in 100° F. (56° C.) decrements] during air cooling, revealed that acicular ferrite forms in the 1100°–900° F. (595°–480° C.) interval. Bainite forms mainly in the lower portion of this interval. The microstructure of Steels I and J are nearly the same as that of Steel H.

The yield and tensile strengths of the steels in the normalized condition are presented in Table 6 and FIG. 21. Considering first the results for simulated 0.2 in. (5 mm) wall tubes, the reference steel has a yield strength of 76 ksi (525 MPa) which is below the specified yield strength range for N-80. Differences between laboratory processing and mill processing are thought to be responsible for the low yield strength of the laboratory steel. The yield strength of Steel G is substantially below that of N-80(II), indicating that 0.10% Mo cannot offset the combined loss of VN strengthening and reduced carbon content. Raising the molybdenum content to 0.20% in Steel H increases the yield strength practically to the level of N-80(II). An 0.05% Nb addition (Steel J) has no effect on yield strength and the combination of higher molybdenum content and VN strengthening in Steel I provides a considerably higher yield strength than that of N-80(II).

The tensile properties of the simulated 0.3 in. (7.5 mm) wall tube are quite similar to those just described, except that the reference steel exhibits an even lower yield strength, 70 ksi (485 MPa), at this greater wall thickness. Steel H exceeds N-80(II) slightly in yield strength at this greater section-thickness while Steel I is substantially stronger than the reference steel.

TABLE 6

Hardness and Tensile Properties of Normalized Steels

| Steel | Hardness HB | Hardness HRA | Hardness HRB | Tensile Properties: 0.2% Offset Yield Strength, ksi | 0.2% Offset Yield Strength, (MPa) | Tensile Strength, ksi | Tensile Strength, (MPa) | Elongation, % | Reduction of Area, % |
|---|---|---|---|---|---|---|---|---|---|
| 10 mm (0.4 in.) Plate, Simulating 5 mm (0.2 in.) Tube Body Wall | | | | | | | | | |
| N-80(II) | 201 | 56.3 | 93.9 | 75.8 | (523) | 102.0 | (703) | 29.5 | 64.0 |
| G | 192 | 55.2 | 91.4 | 59.2 | (408) | 92.8 | (640) | 29.0 | 63.5 |
| H | 213 | 58.1 | 96.2 | 73.4 | (506) | 102.6 | (707) | 25.0 | 62.5 |
| I | 236 | 60.5 | 99.6 | 85.5 | (590) | 110.5 | (762) | 22.0 | 63.0 |
| J | 216 | 58.5 | 96.8 | 73.8 | (509) | 98.9 | (677) | 24.0 | 65.5 |
| 15 mm (0.6 in.) Plate, Simulating 7.5 mm (0.3 in.) Tube Upset Wall | | | | | | | | | |
| N-80(II) | 224 | 55.2 | 98.8 | 70.3 | (485) | 99.1 | (683) | 26.0 | 60.0 |
| G | 173 | 53.3 | 89.4 | 58.6 | (404) | 92.6 | (638) | 27.5 | 61.0 |
| H | 205 | 57.6 | 95.4 | 72.0 | (496) | 101.8 | (702) | 22.5 | 60.5 |
| I | 183 | 59.5 | 92.0 | 83.1 | (573) | 110.2 | (760) | 20.0 | 60.0 |
| J | 207 | 57.6 | 95.2 | 73.3 | (505) | 101.5 | (700) | 23.0 | 61.0 |

SUMMARY

The Mn-Mo steels in the hot band condition are expected to have at least equivalent formability to annealed conventional low alloy vanadium-strengthened steel for normalized N-80 ERW tubulars. Because the best Mn-Mo steels do not contain vanadium, little variability in ERW processing characteristics is expected. The most promising steel contains about 0.30% C, 1.4% Mn and 0.20% Mo. A vanadium addition to an experimental Mn-Mo steel provides substantially higher strength in the normalized condition. No discernable advantage was derived from a niobium addition to the Mn-Mo normalized ERW steel.

FULL SCALE HEATS

Melting and Production of ERW Pipe

Full scale trials were conducted on both quenched and tempered and as-normalized casing and tubing having compositions similar to two of the experimental steels. Each steel was melted as a 235-ton BOF heat. The steels were cast as ingots and rolled to hot band ranging from 0.2 to 0.3 in. (5 to 7.5 mm) in thickness. To facilitate slitting, forming, and welding, the hot band was coiled above the transformation range, at about 1400° F. (760° C.), to produce hot band in a soft condition. The coils were not annealed prior to shipment as is common with vanadium-strengthened steels. The hot band was slit to width and electric resistance welded into 7 in. (180 mm) diameter pipe. All pipe was rapidly normalized at 1700° F. (925° C.) in a barrel furnace immediately after being welded and inspected.

Quenched and Tempered Tubulars

Steel B from Table 1 was selected for commercial trial production of Q & T products. This steel was produced to provide 0.21C-1.17Mn-0.17Si-0.15Mo. The normalized pipe was stretch-reduced to 5½ in. (140 mm) diameter casing and 2⅞ in. (73 mm) diameter tubing. Both products were then continuously heat treated on the quench and temper line, in which austenitizing and tempering were effected rapidly by induction heating. Two peak austenitizing temperatures—1650° and 1800° F. (900° and 980° C.)—were employed, followed by O.D. spray-quenching with water. Tempering was accomplished by induction heating to 1100°, 1200°, and 1300° F. (595°, 650°, and 705° C.) and cooling in air. Tensile properties, as depicted in FIG. 22 represent material austenitized at 1800° F. (980° C.), while the tubing data points represent average values for material austenitized at 1650° and 1800° F. (900° and 980° C.). There is little difference in properties between casing and tubing. Yield and tensile strengths are relatively high; even at the highest tempering temperature, 1300° F. (705° C.), the yield strength curve lies in the upper portion of the specified range for N-80. There are several probable reasons why the tensile properties of the commercially processed steel lie well above those for the laboratory heat of Steel B:

(1) Laboratory specimens represented the inside surface location of 0.4 in. (10 mm) wall casing, whereas the commerical data were obtained from specimens of 0.217 and 0.304 in. (5.5 and 7.7 mm) wall tubulars having the full wall thickness.

(2) It was not feasible, by laboratory simulation, to fully match the very rapid induction heating rates employed on the full scale heats.

(3) The tensile properties could have been raised by the cold straightening of casing and tubing and by the cold sizing of casing. The high tensile properties shown in FIG. 22 suggest that the subject steel could be considered for tubulars of higher strength than N-80. Obviously, a lower carbon content, such as the 0.15% C level of experimental Steel C, would facilitate tempering into the N-80, and especially the L-80, yield strength range.

The results of microhardness traverses taken through the wall of three Q & T tubes are shown in FIG. 23. These tubes had been austenitized at 1800° F. (980° C.) before quenching and were then tempered at the temperatures represented in FIG. 23. Hardness is relatively uniform at all tempering temperatures, the maximum variation is 2½ HRC units. While a slight hardness gradient through the tube wall is observed at the lowest tempering temperature, after tempering at 1300° F. (705° C.) the curve is horizontal. The microhardness traverses indicate the absence of decarburization which is an advantage of rapid induction heating. The micrographs presented in FIGS. *24a* and *24b* of tubing tempered at 1300° F. (705° C.) reveal the uniform tempered martensitic structure of the Mn-Mo Steel.

Normalized Tubulars

A full scale heat was produced based on Steel H from Table 1, but with higher carbon and manganese contents. This steel contained 0.37C-1.55Mn-0.27Si-0.22Mo.

Following the ERW pipemaking, inspection, and normalizing, the 7 in. (180 mm) diameter pipe was processed to 2⅞ by 0.217 in. (73 by 5.5 mm) tubing on a stretch-reduction mill. This tubing was then normalized by induction heating rapidly to the desired temperature followed by air cooling. To assess the effect of normalizing temperature on tensile properties, tubing was subjected to a wide range of normalizing temperatures from about 1600° to 1950° F. (870°–1065° C.). The yield and tensile strengths resulting from these normalizing treatments are shown in FIG. 25. There is little variation in strength over this range of normalizing temperature, except for a small increase in strength at the lowest normalizing temperatures. The minimum specified N-80 yield strength is comfortably exceeded at all normalizing temperatures, and all tensile strengths for the Mn-Mo heat lie well above the 100 ksi (690 MPa) minimum value for N-80.

The microstructure of commercially produced normalized tubing is shown in FIGS. *26a* and *26b* reveals a microstructure of predominantly acicular ferrite with some fine polygonal ferrite. The grains of acicular ferrite are shown more clearly in the SEM micrograph of FIG. *26b*. This micrograph also reveals the bainite that forms later in the cooling cycle after the acicular ferrite has formed. The ability of the Mn-Mo steel to develop the fine, predominantly acicular ferrite-plus-bainite microstructure shown in FIGS. *26a* and *26b* is the reason why the Mn-Mo steel can meet N-80 properties. Because this desirable microstructure develops during air cooling of the normalized tubular but not during coil cooling, the steel may be easily fabricated from hot band without a costly annealing cycle and yet develop uniform N-80 properties after normalizing.

An evaluation of the experimental and full scale heats of Mn-Mo steels for ERW production of oil country tubulars has led to the following conclusions:

Summary of Quenched and Tempered Steels

1. Lowering the carbon content of conventional Q & T N-80 steel and adding molybdenum produces smaller quantities of pearlite and lower yield and tensile strengths in the as-rolled hot band. Lower hot band strength favors the production of thicker-walled high strength tubulars with existing ERW equipment.

2. The hardenability of these Mn-Mo steels is approximately the same as that of conventional N-80 steel, allowing these steels to develop a predominantly martensitic structure with some bainite at the internal surface of simulated 0.4 in. (10 mm) wall casing externally water quenched. Hardenability is drastically reduced by the addition of 0.05% Nb and moderately reduced by the addition of 0.10% V.

3. Yield strength in these lower-carbon Mn-Mo steels is significantly less sensitive to variations in tempering temperature than that of the conventional C-Mn steel.

4. Quenched and tempered ERW casing and tubing containing 0.21C-1.17Mn-0.17Si-0.15Mo produced from full scale heats of hot band steel, exhibit unexpectedly high yield and tensile strengths after rapid induction tempering. This result suggests the possible use of this steel for higher strength grades such as S-95 and P-110. The use of a lower carbon content—perhaps 0.15% C—in this steel is indicated for L-80 and N-80 tubulars where induction heat treatment is employed or where greater ease of slitting, pipe forming, and welding is desired.

SUMMARY OF NORMALIZED STEELS

1. The addition of molybdenum to a medium carbon manganese steel promotes the formation of an acicular ferrite/bainite microstructure during air cooling from the normalizing temperature. This structure provides sufficient strength to meet N-80 properties without the need for vanadium-nitrogen strengthening.

2. Yield strength in simulated 0.3 in. (7.5 mm) upset wall is virtually the same as in simulated 0.2 in. (5 mm) body wall in the molybdenum-containing steel and is less sensitive to wall thickness than for vanadium-strengthened steel.

3. Normalized ERW tubing produced from full scale heats of hot band containing 0.37C-1.55Mn-0.27Si-0.22Mo exhibits little variation in yield and tensile strength over a range of normalizing temperatures from 1600° to 1950° F. (870° to 1065° C.). Minimum yield strength for N-80 is exceeded at all normalizing temperatures, and tensile strengths lie well above the 100 ksi (690 MPa) minimum for N-80. Finally, the steel may be easily fabricated from as-rolled hot band without a prior annealing cycle.

The quenched and tempered heat treatment for the Mn-Mo steel composition consisting essentially of about 0.10 to 0.25% C, about 0.75 to 1.5% Mn, 0.075 to 0.25% Mo and the balance essentially iron is as follows:

(A) Heating the steel to an austenitizing temperature and holding for a time sufficient to convert the microstructure substantially to austenite, e.g. at about 1550° F. to 2100° F. [about 845° C. to 1150° C.];

(B) Quenching the austenitized steel with water or brine; and then (C) Tempering the steel at a temperature of about 1050° F. to 1325° F. [565° C. to 720° C.] for time sufficient to achieve the desired L-80, N-80 type properties.

When the Mn-Mo steel composition employed consists essentially of about 0.25 to 0.40% C, about 0.75 to 1.5% Mn, about 0.2 to 0.4% Mo and the balance essentially iron, the N-80 type properties are obtained by normalizing the steel using following procedure:

(A) Heating the steel to an austenitizing temperature of about 1550° F. to 2100° F. [845° C. to 1150° C.] and holding at temperature for a time sufficient to transform the steel to substantially austenite; and then (B) Air cooling the steel to produce the desired N-80 type properties.

As stated earlier, an advantage of the foregoing type steels of the invention heat treated in the manner stated is that the steels are significantly less sensitive to a variance in properties normally observed for the conventional steels.

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. As an article of manufacture, a quenched and tempered high strength low-alloy steel tubular product of the L-80 and N-80 type suitable for use as an oil well tubular member having a yield strength of a least 90 ksi, said product being formed of a composition consisting essentially of about 0.15 to 0.20% C, about 0.1 to 0.2% Mo, about 0.002 to 0.03% N, about 1 to 1.4% Mn, about 0.15 to 0.25% Si, and the balance essentially iron, said product having been produced by heating to an austenitizing temperature of about 1550° F. to 2100° F. and holding at temperature for a time sufficient to convert the microstructure to austenite and then liquid quenching said product followed by tempering the quenched product at a temperature of about 1050° F. to 1325° F. for a time sufficient to produce desired properties and characterized metallographically by a predominantly martensitic structure with some bainite.

2. A method for producing a tubular product of a high strength low-carbon steel of the L-80 and N-80 type having a yield strength of at least 90 ksi which comprises, establishing a steel bath consisting essentially of about 0.15 to 0.20% C, about 0.1 to 0.2% Mo, about 0.002 to 0.03% N, about 1 to 1.4% Mn, about 0.15 to 0.25% Si, and the balance essentially iron, casting said bath into an ingot, converting said ingot into a hot rolled band of predetermined thickness for use in producing a tubular product therefrom, slitting said band into skelp of a predetermined width for cold forming in a tubular product, cold forming said skelp into a tubular shape with its opposite edges in abutting relationship, subjecting said abutted edges to electric resistance seam welding to produce a seam-welded tubular product of unitary structure, and then heat treating said tubular product by heating said product to an austenitizing temperature of about 1550° F. to 2100° F. and holding at temperature for a time sufficient to convert the microstructure to austenite and then liquid quenching said product followed by tempering the quenched product at a temperature of about 1050° F. to 1325° F. for a time sufficient to produce desired properties, the product being characterized by a metallographic structure of predominantly martensite with some bianite.

3. A quenched and tempered high strength low-alloy steel, said steel alloy having a yield strength of at least 90 ksi and being formed of a composition consisting essentially of about 0.15 to 0.20% C, about 0.1 to 0.2% Mo, about 0.002 to 0.03% N, about 1 to 1.4% Mn, about 0.15 to 0.25% Si, and the balance consisting essentially of iron, said steel product having been produced by heating to an austenitizing temperature of about 1550° F. to 2100° F. and holding at temperature for a time sufficient to convert the microstructure to austenite and then liquid quenching said product followed by tempering the quenched product at a temperature of about 1050° F. to 1325° F. for a time sufficient to produce desired properties and characterized metallographically by a predominantly martensitic structure with some bainite.

* * * * *